US005895449A

United States Patent [19]

Nakajima et al.

[11] Patent Number: 5,895,449

[45] Date of Patent: Apr. 20, 1999

[54] SINGING SOUND-SYNTHESIZING APPARATUS AND METHOD

[75] Inventors: Yasuyoshi Nakajima; Masahiro Koyama, both of Hamamatsu, Japan

[73] Assignee: Yamaha Corporation, Hamamatsu, Japan

[21] Appl. No.: 08/898,591

[22] Filed: Jul. 22, 1997

[30] Foreign Application Priority Data

Jul. 24, 1996 [JP] Japan ..... 8-212208
Jul. 30, 1996 [JP] Japan ..... 8-215930

[51] Int. Cl.[6] ..... G10L 9/02; G10H 1/36

[52] U.S. Cl. ..... 704/278; 704/258; 84/622

[58] Field of Search ..... 84/622, 659; 704/258, 704/260, 278

[56] References Cited

U.S. PATENT DOCUMENTS

| | | | |
|---|---|---|---|
| 4,527,274 | 7/1985 | Gaynor . | |
| 4,979,216 | 12/1990 | Malsheen et al. . | |
| 5,321,794 | 6/1994 | Tamura | 704/260 |
| 5,703,311 | 12/1997 | Ohta | 84/622 |
| 5,744,741 | 4/1998 | Nakajima et al. | 84/622 |
| 5,747,715 | 5/1998 | Ohta et al. | 84/609 |

FOREIGN PATENT DOCUMENTS

| | | |
|---|---|---|
| 3-200300 | 9/1991 | Japan . |
| 4-251297 | 9/1992 | Japan . |

*Primary Examiner*—David R. Hudspeth
*Assistant Examiner*—Susan Wieland
*Attorney, Agent, or Firm*—Graham & James LLP

[57] ABSTRACT

A singing sound-synthesizing apparatus sequentially synthesizes vocal sounds based on singing data including lyric data of a lyric formed of a plurality of phonemes and sounding data designating a sounding time period over which the lyric data is sounded. A designating device designates a predetermined voiced phoneme from the plurality of phonemes of the lyric data. A sounding control device carries out sounding control such that sounding of the predetermined voiced phoneme designated by the designating device is started within the sounding time period designated for the plurality of phonemes by the sounding data and continued until the sounding time period designated for the plurality of phonemes elapses. In another form, ones of phoneme parameter sets and ones of coarticulation parameter sets corresponding to signing data are read from a phoneme data storing the phoneme parameter sets and the coarticulation parameter sets. A control signal is selectively supplied to at least one of a formant-synthesizing tone generator device that synthesizes formants of phonemes to be sounded to generate vocal sounds and a PCM tone generator device that generates vocal sounds by pulse code modulation, the PCM tone generator device having a waveform memory storing waveforms of unvoiced consonants, based on the corresponding ones of the phoneme parameter sets and the corresponding ones of the coarticulation parameter sets read from the phoneme data base to cause the at least one of the formant-synthesizing tone generator device and the PCM tone generator device to generate a vocal sound.

14 Claims, 19 Drawing Sheets

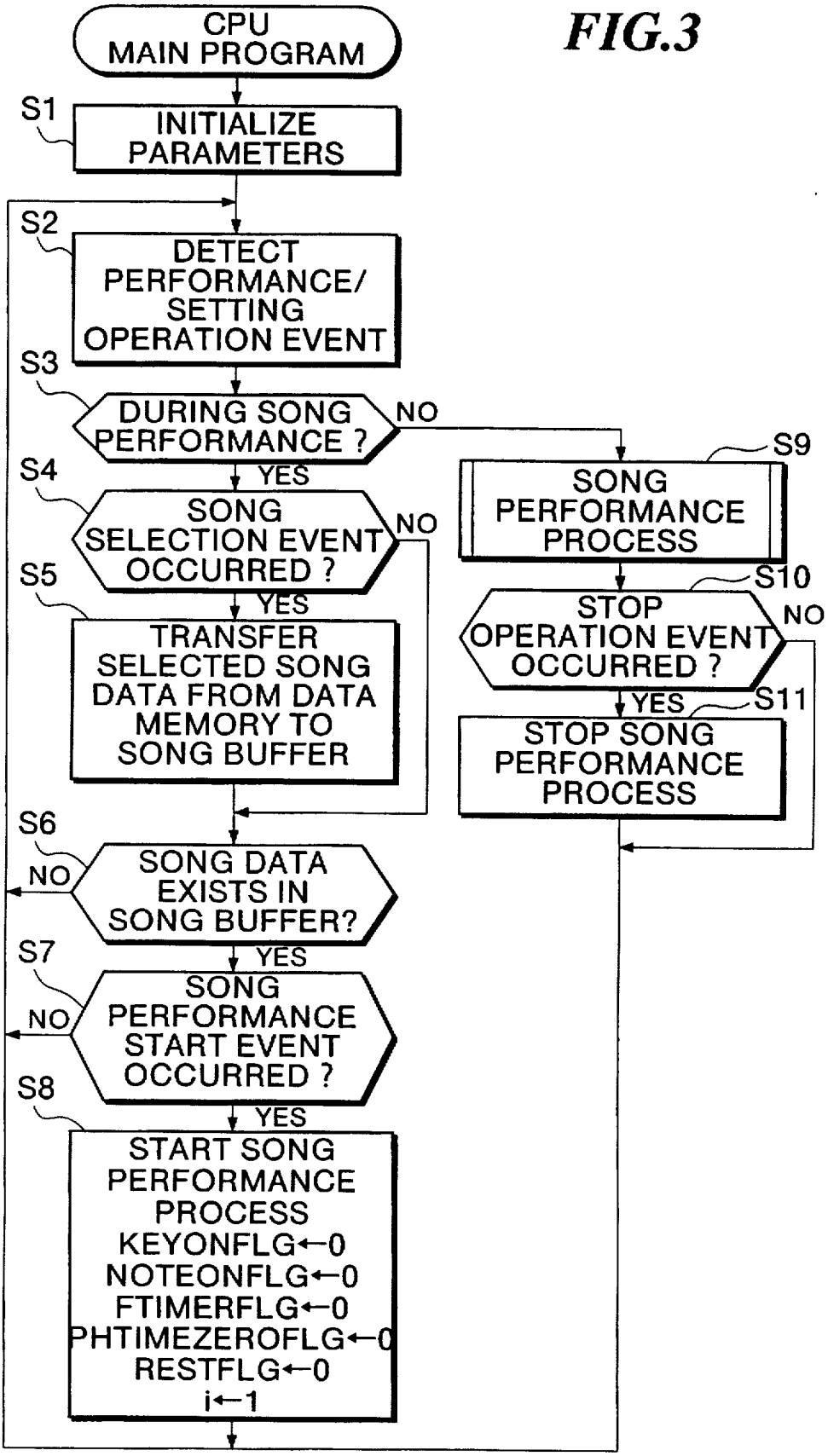
FIG.3
CPU MAIN PROGRAM
S1
INITIALIZE PARAMETERS
S2
DETECT PERFORMANCE/ SETTING OPERATION EVENT
S3
DURING SONG PERFORMANCE ?
NO
YES
S4
SONG SELECTION EVENT OCCURRED ?
NO
YES
S5
TRANSFER SELECTED SONG DATA FROM DATA MEMORY TO SONG BUFFER
S6
SONG DATA EXISTS IN SONG BUFFER?
NO
YES
S7
SONG PERFORMANCE START EVENT OCCURRED ?
NO
YES
S8
START SONG PERFORMANCE PROCESS
KEYONFLG←0
NOTEONFLG←0
FTIMERFLG←0
PHTIMEZEROFLG←0
RESTFLG←0
i←1
S9
SONG PERFORMANCE PROCESS
S10
STOP OPERATION EVENT OCCURRED ?
NO
YES
S11
STOP SONG PERFORMANCE PROCESS

*FIG.16D*

| |
|---|
| h |
| 5 |
| i |
| 0 |
| t |
| 5 |
| KEYON C3 V=64 |
| DUR96 |
| KEYOFF C3 COMBIFLG |

*FIG.16E*

| |
|---|
| h |
| 5 |
| a |
| 0 |
| g |
| 5 |
| a |
| 35 |
| i |
| 50 |
| KEYON a5 V=85 |
| DUR127 |
| KEYOFF a5 COMBIFLG |

SINGING SOUND-SYNTHESIZING APPARATUS AND METHOD

BACKGROUND OF THE INVENTION

1. Field of the Invention

This invention relates to a singing sound-synthesizing apparatus and method for synthesizing human vocal sounds by sounding phonemes of a lyric of a song based on lyric data to thereby generate singing sounds of the song.

2. Prior Art

Conventionally, there have been proposed various techniques of synthesizing vocal sounds, including a vocal sound synthesizer based on a formant synthesization method proposed e.g. by Japanese Laid-Open Patent Publication (Kokai) No. 3-200300 and Japanese Laid-Open Patent Publication (Kokai) No. 4-251297.

A vocal sound synthesizer based on the formant synthesization method disclosed by Japanese Laid-Open Patent Publication (Kokai) No. 4-251297 comprises memory means storing in a plurality of steps, data of parameters related to formants which change in time sequence, reading means for reading the parameter data from the memory means by the plurality of steps in time sequence to generate a vocal sound, and formant-synthesizing means which is supplied with the read parameter data, for synthesizing a musical sound having formant characteristics determined by the parameter data. This synthesizer changes formants of a vocal sound signal in time sequence.

When a singing sound is synthesized by the prior art technique based on the formant synthesization method, if an English lyric "hit" is sounded in a manner corresponding to one quarter note, sounding time periods T(h), T(i) and T(t) in terms of absolute time periods are assigned to respective phonemes "h", "i", and "t" of the lyric, and parameters are set such that the sum of the sounding time periods T(h)+T(i)+T(t) becomes equal to a sounding time period over which the quarter note is sounded stored in the memory means (referred to hereinafter as "the first conventional method"). Alternatively, the sum of the sounding time periods T(h)+T(i)+T(t) is set to a shorter time period than the sounding time period over which the quarter note is sounded, and the sounding of the lyric is stopped when the sounding time period assigned to the last phoneme "t" has elapsed, or the sounding of the last phoneme "t" is continued until the sounding time period over which the quarter note is sounded elapses (referred to hereinafter as "the second conventional method").

According to the first conventional method, however, the singing sound can be generated only at a predetermined tempo. One way to overcome this inconvenience may be a method of determining the sounding time periods of the phonemes in terms of relative time periods. This method, however, has the disadvantage that if the sounding time periods, particularly, of unvoiced sounds (consonants), such as phonemes "h" and "t" are changed according to the tempo, the resulting singing sound is unnatural.

On the other hand, according to the second conventional method, both of the stoppage of the sounding of the lyric upon the lapse of the sounding time period assigned to the phoneme "t" and the continuation of the sounding of the phoneme "t" until the sounding time period over which the quarter note is sounded lapses result in an unnatural and odd sound.

A so-called "Synthesis-by-rule" method is another method of synthesizing vocal sounds of desired words.

According to this method, vocal sound waves are analyzed in units of vocal sounds having short lengths, such as phonemes, and the resulting parameters are stored as vocal sound data, and control signals required for driving a vocal sound synthesizer are formed according to a predetermined rule based on the stored vocal sound data.

The "Synthesis-by-rule" method is often applied to synthetization of vocal sounds using PCM waveforms. In general, the synthesization of vocal sounds has a large problem to be solved, i.e. coarticulation between phonemes for synthesizing natural vocal sounds. To realize proper coarticulation, the method applied to the vocal sound synthesizer using PCM waveforms can successfully achieve proper coarticulation by using phoneme fractions edited by a waveform-superposing method or the like, and preparing a lots of waveforms in advance.

On the other hand, a singing sound synthesizer has been proposed by the present assignee in Japanese Patent Application No. 7-218241 which applies the "Synthesis-by-rule" method to synthesization of music sounds, to synthesize a natural singing sound based on lyric data.

When a singing sound synthesizer employs the "Synthesis-by-rule" method applied to synthesization of singing sounds using PCM waveforms, there arise inconveniences that a large volume of data are required, and it is difficult to convert voice characteristics to other ones as well as to follow up a large change in pitch.

When a singing sound synthesizer employs the formant synthesization method, this synthesizer is advantageous over the synthesizer based on the "Synthesis-by-rule" method applied to the PCM waveform synthesization in that smooth coarticulation can be effected, only a small amount of data is required, it is possible to change the pitch over a wide range, etc. However, so far as the level of recognition of a sound, i.e. naturalness of a synthesized sound is concerned, the former is inferior to the latter. Particularly, it is difficult for the formant synthesization method to generate sounds of consonants which are natural.

SUMMARY OF THE INVENTION

It is a first object of the invention to provide a singing sound-synthesizing apparatus and method which is capable of generating singing sounds which are natural even if the tempo is changed.

It is a second object of the invention to provide a singing sound-synthesization apparatus and method which is capable of generating singing sounds which are more natural and higher in quality by sounding unvoiced consonant sounds by the use of PCM waveforms.

To attain the first object, according to a first aspect of the invention, there is provided a singing sound-synthesizing apparatus for sequentially synthesizing vocal sounds based on singing data including lyric data of a lyric formed of a plurality of phonemes and sounding data designating a sounding time period over which the lyric data is sounded.

The singing sound-synthesizing apparatus according to the first aspect of the invention is characterized by comprising a designating device that designates a predetermined voiced phoneme from the plurality of phonemes of the lyric data, and a sounding control device that carries out sounding control such that sounding of the predetermined voiced phoneme designated by the designating device is started within the sounding time period designated for the plurality of phonemes by the sounding data and continued until the sounding time period designated for the plurality of phonemes elapses.

Preferably, the sounding control device causes a phoneme of the plurality of phonemes, which follows the predetermined voiced phoneme designated by the designating device, to be sounded after the sounding time period designated for the plurality of phonemes by the sounding data has elapsed.

More preferably, the sounding data designates the sounding time period in terms of relative time period which can be varied depending at least on a tempo at which the singing data is sounded.

Further preferably, the lyric data comprises phoneme code data designating each of the plurality of phonemes, and phoneme sounding data designating a phoneme sounding time period corresponding to the each of the plurality of phonemes each in terms of absolute time period.

Still more preferably, the singing data corresponds to one musical note.

Preferably, the singing sound-synthesizing apparatus includes a formant-synthesizing tone generator device that synthesizes formants of each of the plurality of phonemes to generate a vocal sound signal, a storage device that stores the singing data, and a phoneme data base that stores phoneme parameter sets for generating the plurality of phonemes and coarticulation parameter sets each for coarticulating a preceding one of the plurality of phonemes and a following one of the plurality of phonemes, and the sounding control device reads the singing data from the storage device, reads ones of the phoneme parameter sets and ones of the coarticulation parameter sets corresponding to the read singing data from the phoneme data base, and supplies a control signal to the formant-synthesizing tone generator device based on the corresponding ones of the phoneme parameter sets and the corresponding ones of the coarticulation parameter sets read from the phoneme data base to cause the formant-synthesizing tone generator device to generate the vocal sound signal.

To attain the first object, according to a second aspect of the invention, there is provided a singing sound-synthesizing method for sequentially synthesizing vocal sounds based on singing data including lyric data of a lyric formed of a plurality of phonemes and sounding data designating a sounding time period over which lyric data is sounded, the singing sound-synthesizing method comprising the steps of designating a predetermined voiced phoneme from the plurality of phonemes of the lyric data, and carrying out sounding control such that sounding of the predetermined voiced phoneme designated is started within the sounding time period designated for the plurality of phonemes by the sounding data and continued until the sounding time period designated for the plurality of phonemes elapses.

Preferably, the singing sound-synthesizing method includes the step of causing a phoneme of the plurality of phonemes, which follows the predetermined voiced phoneme designated, to be sounded after the sounding time period designated for the plurality of phonemes by the sounding data has elapsed.

To attain the second object, according to a third aspect of the invention, there is provided a singing sound-synthesizing apparatus for reproducing a musical piece including lyrics, comprising a formant-synthesizing tone generator device that synthesizes formants of phonemes to generate vocal sounds, the formant-synthesizing tone generator device having a voiced sound tone generator group for generating voiced sounds and an unvoiced sound tone generator group for generating unvoiced sounds, a PCM tone generator device that generates vocal sounds by pulse code modulation, the PCM tone generator device having a waveform memory storing waveforms of unvoiced consonants, a storage block that stores singing data corresponding to each lyric of the lyrics of the musical piece, a phoneme data base that stores phoneme parameter sets for generating the phonenes and coarticulation parameter sets each for coarticulating a preceding one of the phonemes and a following one of the phonemes, and a control device that reads the singing data from the storage block, reads ones of the phoneme parameter sets and ones of the coarticulation parameter sets corresponding to the read singing data from the phoneme data base, and supplies a control signal selectively to at least one of the formant-synthesizing tone generator device and the PCM tone generator device based on the corresponding ones of the phoneme parameter sets and the corresponding ones of the coarticulation parameter sets read from the phoneme data base to cause the at least one of the formant-synthesizing tone generator device and the PCM tone generator device to generate a vocal sound.

Preferably, when a phoneme designated by any of the corresponding ones of the phoneme parameter sets is one of the unvoiced consonants, the control device supplies the control signal at least to the PCM tone generator device to cause the PCM tone generator block to generate the one of the unvoiced consonants.

Preferably, the singing data or each of the phoneme parameter sets includes tone generator-designating data for designating the at least one of the formant-synthesizing tone generator device and the PCM tone generator device, the control device supplying the control signal to the at least one of the formant-synthesizing tone generator device and the PCM tone generator device designated by the tone generator-designating data.

Preferably, the phoneme data base further stores phoneme parameter sets and coarticulation parameter sets obtained by analyzing the waveforms of the unvoiced consonants stored in the waveform memory, the control device causing, when a phoneme designated by any of the corresponding ones of the phoneme parameter sets is one of the unvoiced consonants, both of the PCM tone generator device and the unvoiced sound tone generator group of the formant-synthesizing tone generator device to carry out processing for sounding the one of the unvoiced consonants, and at the same time inhibiting the unvoiced sound tone generator group from outputting results of the processing, thereby effecting smooth coarticulation between the one of the unvoiced consonants and a following voiced sound.

Preferably, the control device causes the unvoiced sound tone generator group to generate an unvoiced sound which is to be generated simultaneously with a voiced sound.

To attain the first object, according to a fourth aspect of the invention, there is provided a machine readable storage medium containing instructions for causing the machine to perform a singing sound-synthesizing method of sequentially synthesizing vocal sounds based on singing data including lyric data of a lyric formed of a plurality of phonemes and sounding data designating a sounding time period over which the vocal sounds are generated, the singing sound-synthesizing method comprising the steps of designating a predetermined voiced phoneme from the plurality of phonemes of the lyric data, and carrying out sounding control such that sounding of the predetermined voiced phoneme designated is started within the sounding time period designated for the plurality of phonemes by the sounding data and continued until the sounding time period designated for the plurality of phonemes elapses.

To attain the second object, according to a fifth aspect of the invention, there is provided a machine readable storage medium containing instructions for causing the machine to perform a singing sound-synthesizing method of sequentially synthesizing vocal sounds based on singing data to thereby reproduce a musical piece including lyrics, the singing sound-synthesizing method comprising the steps of reading ones of phoneme parameter sets and ones of coarticulation parameter sets corresponding to the singing data from a phoneme data storing the phoneme parameter sets and the coarticulation parameter sets, and supplying a control signal selectively to at least one of a formant-synthesizing tone generator device that synthesizes formants of phonemes to be sounded to generate vocal sounds, and a PCM tone generator device that generates vocal sounds by pulse code modulation, the PCM tone generator device having a waveform memory storing waveforms of unvoiced consonants, based on the corresponding ones of the phoneme parameter sets and the corresponding ones of the coarticulation parameter sets read from the phoneme data base to cause the at least one of the formant-synthesizing tone generator device and the PCM tone generator device to generate a vocal sound.

The above and other objects, features, and advantages of the invention will become more apparent from the following detailed description taken in conjunction with the accompanying drawings.

BRIEF DESCRIPTION OF THE DRAWINGS

FIG. 3 is a flowchart showing a main routine executed by the first embodiment;

FIGS. 16A to 16E are diagrams showing data formats of singing data LYRIC SEQ DATA.

DETAILED DESCRIPTION

The invention will now be described in detail with reference to drawings showing embodiments thereof.

Figure 1:
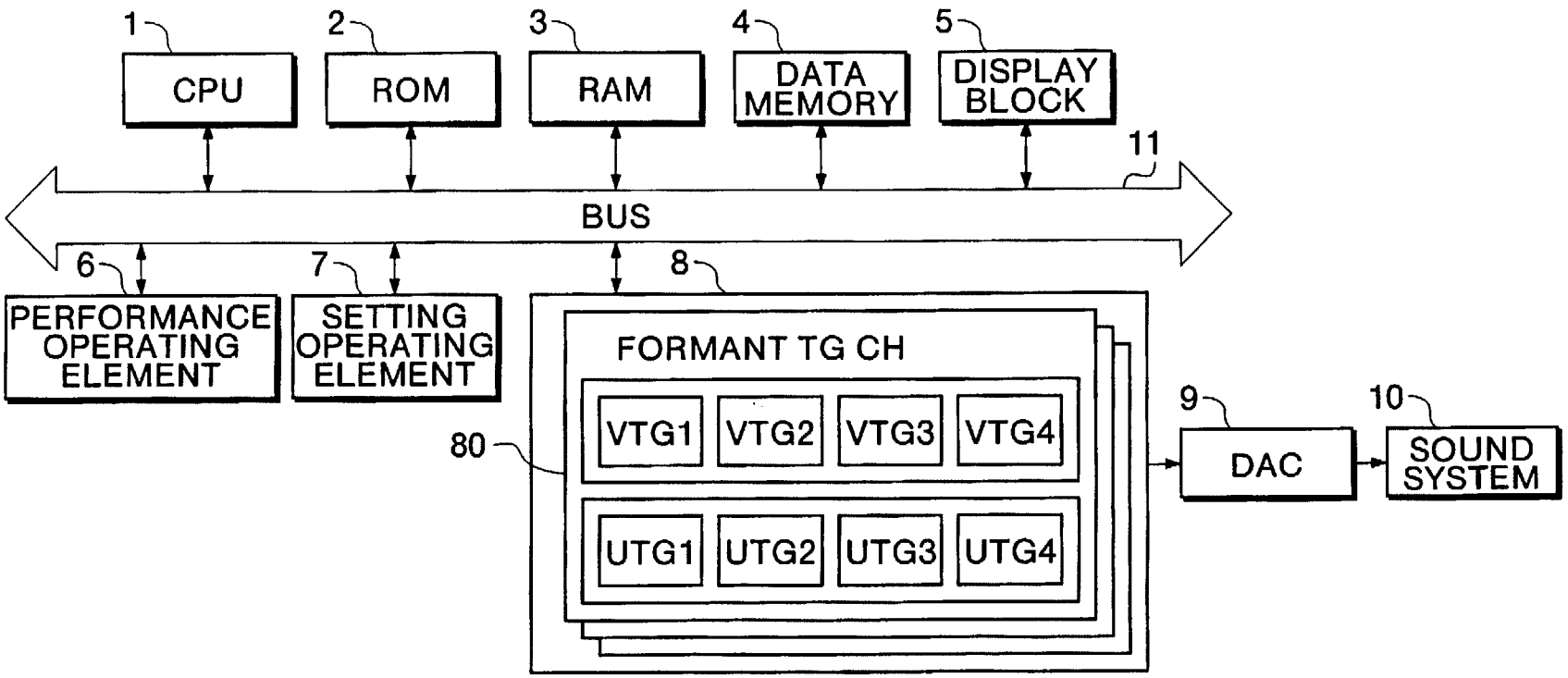
FIG. 1 is a block diagram showing the arrangement of an electronic musical instrument incorporating a singing sound-synthesizing apparatus according to a first embodiment of the invention.

FIG. 1 shows the arrangement of an electronic musical instrument incorporating a singing sound-synthesizing apparatus according to a first embodiment of the invention. The electronic musical instrument is comprised of a CPU 1 for controlling the operation of the whole instrument, a ROM 2 storing programs executed by the CPU 1, tables required in executing the programs and formant data for synthesizing sounds having desired timbres, a RAM 3 used as a working area by the CPU 1 and for storing data being processed and the like, a data memory 4 for storing song data for synthesizing singing sounds and accompaniment data, a display block 5 for displaying various parameters and operation modes of devices of the instrument, a performance operating element 6, such as a keyboard, via which the player operates the instrument for performance, a setting operating element 7 for setting a performance mode, etc., a formant-synthesizing tone generator 8 for synthesizing vocal sounds or instrument sounds based on formant data, a digital/analog converter (DAC) 9 for converting a digital signal from the formant-synthesizing tone generator 8 to an analog signal, a sound system for amplifying the analog signal from the DAC 9 to generate a musical sound based on the amplified analog signal, and a bus 11 connecting the above component 1 to 8 to each other.

The formant-synthesizing tone generator 8 has a plurality of tone generator channels 80 each comprised of four vowel (voiced sound) formant-synthesizing tone generators VTG1 to VTG4 and four consonant (unvoiced sound) formant-synthesizing tone generators UTG1 to UTG4. The technique of providing four formant-synthesizing tone generators for each of a consonant section and a vowel section, and adding together outputs from these formant-synthesizing tone generators to thereby synthesize a vocal sound is disclosed e.g. in Japanese Laid-Open Patent Publication (Kokai) No. 3-200300.

Figure 2A:
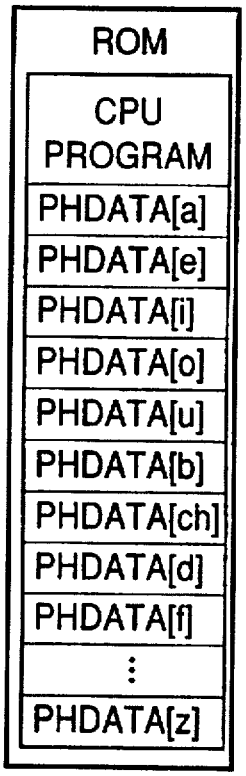
FIGS. 2A to 2F are diagrams showing data formats of parameters stored in memory devices in FIG. 1.
Figure 2B:
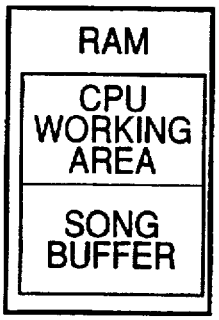

FIGS. 2A and 2B show data areas in the ROM 2 and the RAM 3 and FIGS. 2C to 2F show data formats of data stored in the data memory 4.

The ROM 2 stores programs executed by the CPU 1 and formant parameter data PHDATA (FIG. 2A). The formant parameter data PHDATA is comprised of formant parameter sets PHDATA[a], PHDATA[e], PHDATA[i], . . . . and PHDATA[z] which correspond to respective phonemes (vowels (voiced sounds) and consonants) of the Japanese language and the English language, and each formant parameter set is comprised of parameters such as a formant center frequency, a formant level, and a formant bandwidth. These parameters are formed as time-sequence data to be sequentially read out at a predetermined timing to reproduce formants which change as time elapses.

The RAM 3 has the working area used by the CPU 1 for calculation, and a song buffer into which is loaded performance sequence data (FIG. 2B).

Figure 2C:
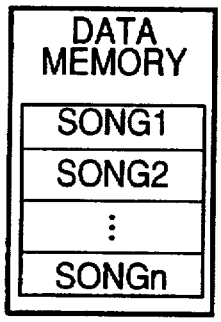
Figure 2D:
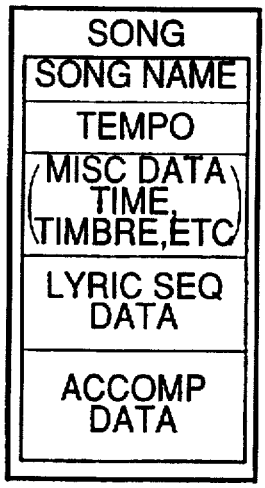
Figure 2E:
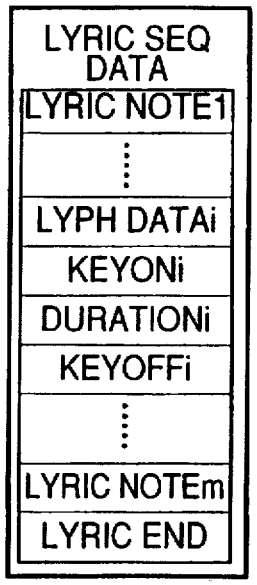

The data memory 4 stores n song data SONG1, SONG2, . . . . and SONGn (FIG. 2C). As shown in FIG. 2D, each of the song data SONG is comprised of song name data SONG NAME indicative of the name of a song, tempo data TEMPO indicative of the tempo of the song, other data MISC DATA which designate the meter, timbre, etc., singing data LYRIC SEQ DATA comprised of lyric data, pitch data, velocity data, duration data, etc., and accompaniment data ACCOMP DATA for performance accompaniment.

Figure 2F:
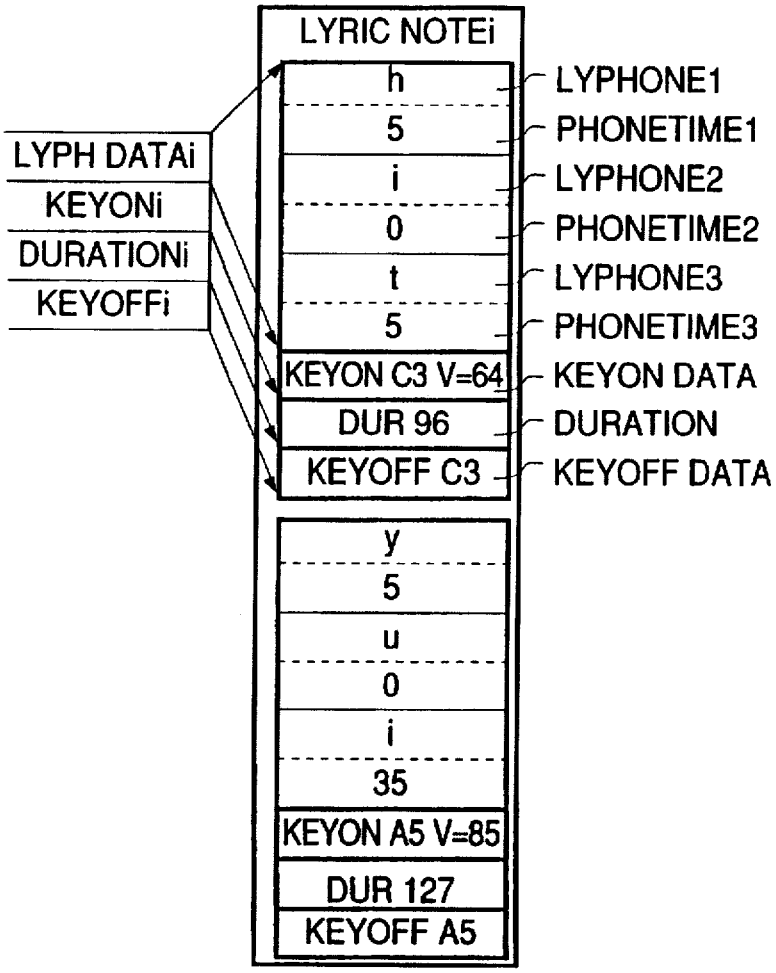

The singing data LYRIC SEQ DATA is comprised of m lyric note data LYRIC NOTE and end data LYRIC END indicative of the end of the singing data. Each of the lyric note data LYRIC NOTE is comprised of lyric phoneme data LYPH DATA, key-on data KEYON, duration data DURATION, and key-off data KEYOFF. The lyric phoneme data LYPH DATA is formed of a sequence of pairs of phoneme code data LYPHONE which designates a phoneme ("h", "i", or "t" in the case of a lyric "hit") and phoneme sounding time data PHONETIME which designates a sounding time period over which each phoneme is to be sounded. The data LYPHONE1 to LYPHONE3 and PHONETIME1 to PHONETIME3 are arranged in the sounding order, as shown in FIG. 2F. The key-on data KEYON is comprised of pitch data (e.g. "C3") and velocity data V(e.g. "64") respectively setting a pitch of the phonemes designated by the lyric phoneme data LYPH DATA and a rise portion of the envelope of the same. The duration data DURATION (e.g. "DUR 96") designates a time period (duration) over which the phonemes designated by the lyric phoneme data LYPH DATA are sounded in terms of a relative time period which is to be converted to data corresponding to an absolute time period according to the tempo data and an interrupt clock. The key-off data KEYOFF designates termination of the sounding of the phonemes designated by the lyric phoneme data.

FIG. 2F shows examples of lyric note data LYRIC NOTE for lyrics "hit" and "yuki". The phoneme sounding time data PHONEMETIME designates, as a rule, a sounding time period over which each phoneme is to be sounded in terms of absolute time period (in the illustrated example, PHONEMETIME1 is set to "5" which corresponds to 8 milliseconds×5=40 milliseconds assuming that the basic time unit is eight milliseconds). However, when the phoneme sounding time data PHONEMETIME is set to "0" (as in the cases of "i" in "hit" and "u" in "yuki", hereinafter called as "zero designation" or "zero designated"), it means that the sounding of the phoneme (vowel) is continued until the lapse of the sounding time period or duration designated by the duration data DURATION in terms of relative time period, as described in detail hereinafter. The sounding of the following phoneme or phonemes ("t" in the case of "hit" and "ki" in the case of "yuki") is controlled such that the phoneme or phonemes are sounded after the duration elapses.

FIG. 3 shows a main routine executed by the CPU 1 of the electronic musical instrument, which is started when the power of the electronic musical instrument is turned on.

First, at a step S1, various parameters are initialized, and then at a step S2, operation events generated by the performance operating element 6 and the setting operating element 7 are detected. At the following step S3, it is determined whether or not a performance process based on song data (SONG performance process) is being executed. If the SONG performance process has not yet been started, the program proceeds to a step S4, wherein it is determined whether or not a selection event for selecting song data has occurred. If no selection event has occurred, the program jumps to a step S6, whereas if a selection event has occurred, the selected song data is transferred from the data memory 4 to the song buffer of the RAM 3, and then the program proceeds to the step S6.

At the step S6, it is determined whether or not song data SONG exists in the song buffer of the RAM 3. If no song data SONG exists in the song buffer, the program returns to the step S2, whereas if song data exists, it is determined at a step S7 whether or not a SONG performance process-starting event has occurred. If no SONG performance process-starting event has occurred, the program returns to the step S2, whereas if SONG performance process-starting event has occurred, initialization is carried out on various flags including a key-on flag KEYONFLG, which, when set to "1", indicates that a sounding process based on lyric note data LYRIC NOTE is being carried out, a note-on flag NOTEONFLG, which, when set to "1", indicates that the present time point is within a sounding time period (hereinafter referred to as "the duration") designated by the duration data DURATION, a formant timer flag FTIMERFLG, which, when set to "1", indicates that the present time point is within a sounding time period designated by the phoneme sounding time data PHONEMETIME, a zero designation flag PHTIMEZEROFLG, which, when set to "1", indicates that the zero designation has been effected, and a rest process flag RESTFLG, which, when set to "1", indicates that a rest process is being carried out after the lapse of the duration In the case of the phoneme being zero-designated, as well as a pointer i, at a step S8, followed by the program returning to the step S2.

When it is determined at the steps S3 that the SONG performance process has been started, the program proceeds from the step S3 to a step S9, wherein the performance process based on the song data SONG loaded into the song buffer of the RAM 3 (executed by a SONG performance process routine shown in FIG. 4) is started. Then, it is determined at a step S10 whether or not a stop operation event for stopping the SONG performance process has occurred. If no stop operation event has occurred, the program immediately returns to the step S2, whereas if a stop operation event has occurred, a terminating process for stopping the SONG performance process is executed at a step S11, followed by the program return is to the step S2.

Figure 4:
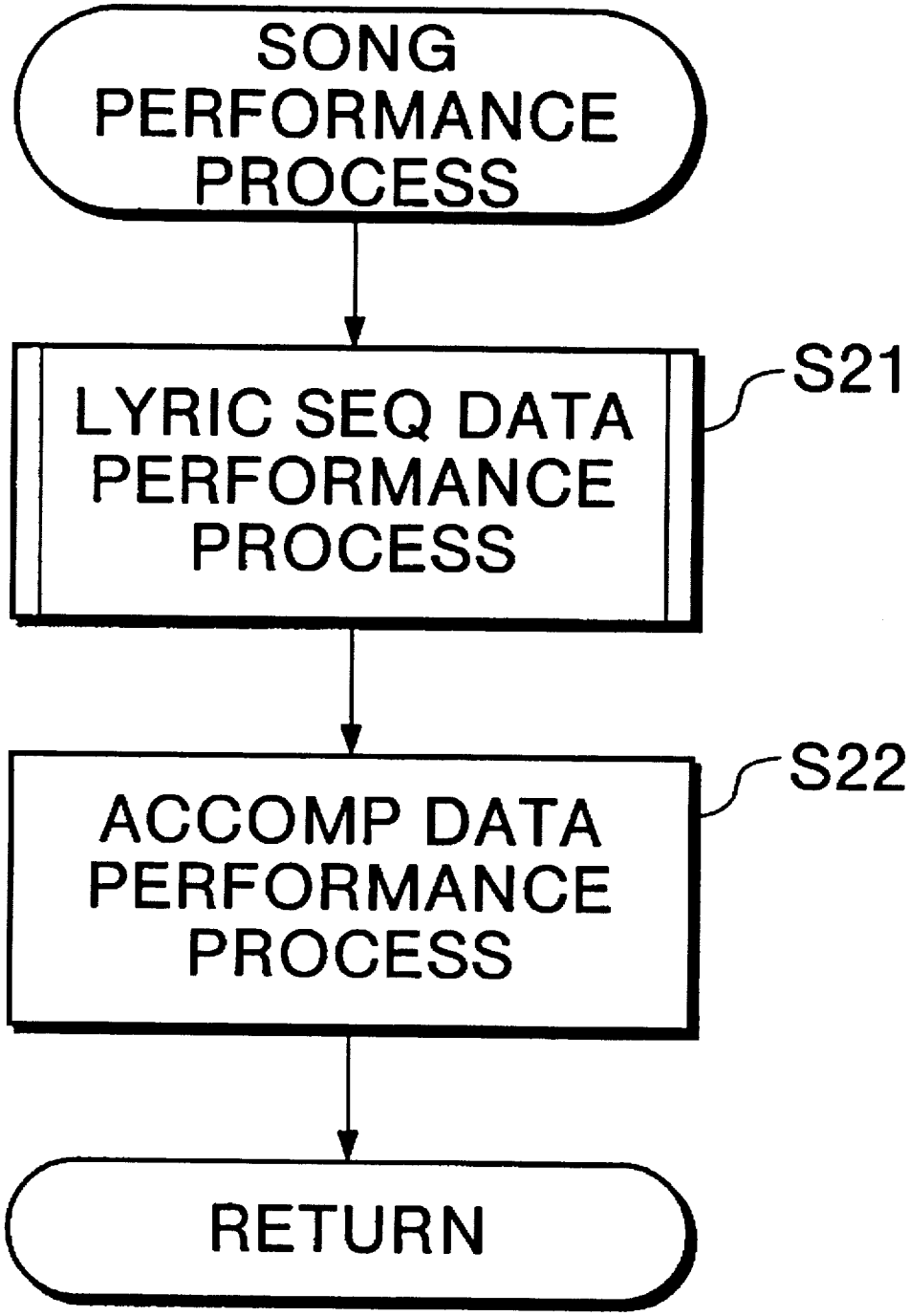
FIG. 4 is a flowchart showing a routine for executing a SONG performance process.

FIG. 4 shows the SONG performance process routine executed at the step S9 in FIG. 3, which is largely comprised of two steps, i.e. a step S21 wherein a performance process based on the singing data LYRIC SEQ DATA (hereinafter referred to as "LYRIC SEQ DATA performance process) is executed, and a step S22 wherein a performance process based on the accompaniment data ACCOMP DATA (hereinafter referred to as "ACCOMP DATA performance process") is executed.

Figure 5:
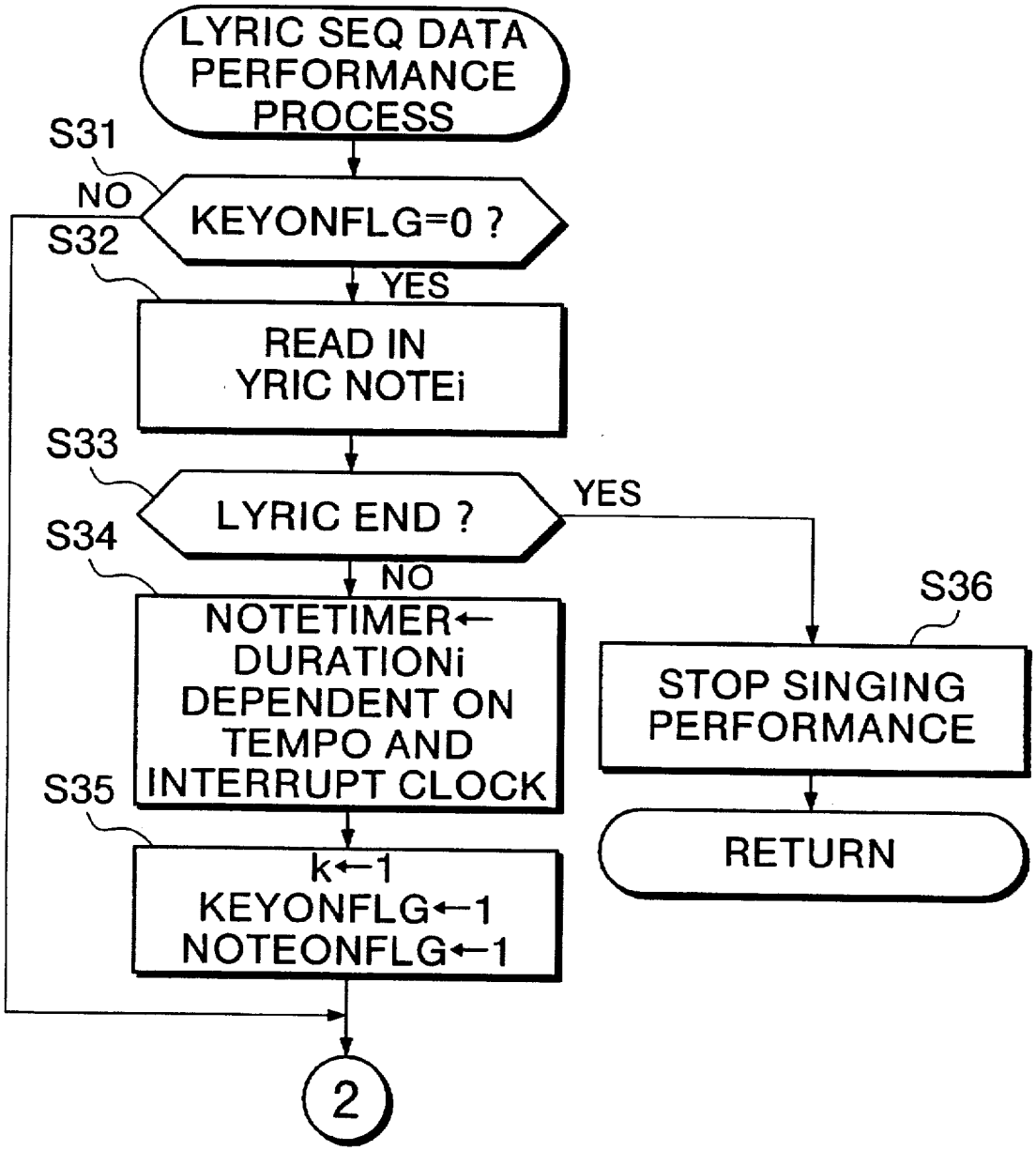
FIG. 5 is a flowchart showing a routine for a singing data (LRYC SEQ DATA) performance process executed at a step S21 in FIG. 4.
Figure 6:
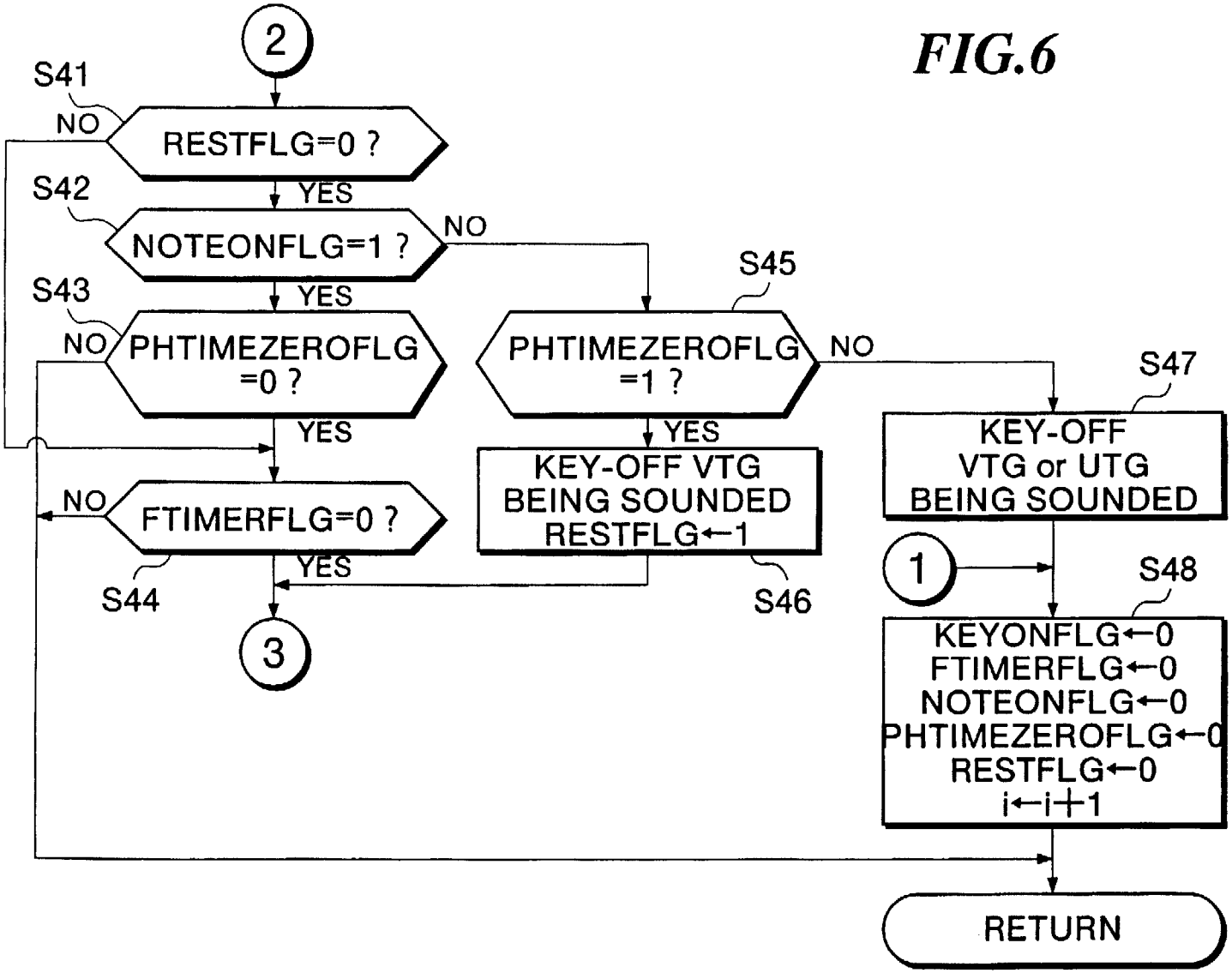
FIG. 6 is a flowchart showing a continued part of the FIG. 5 routine.
Figure 7:
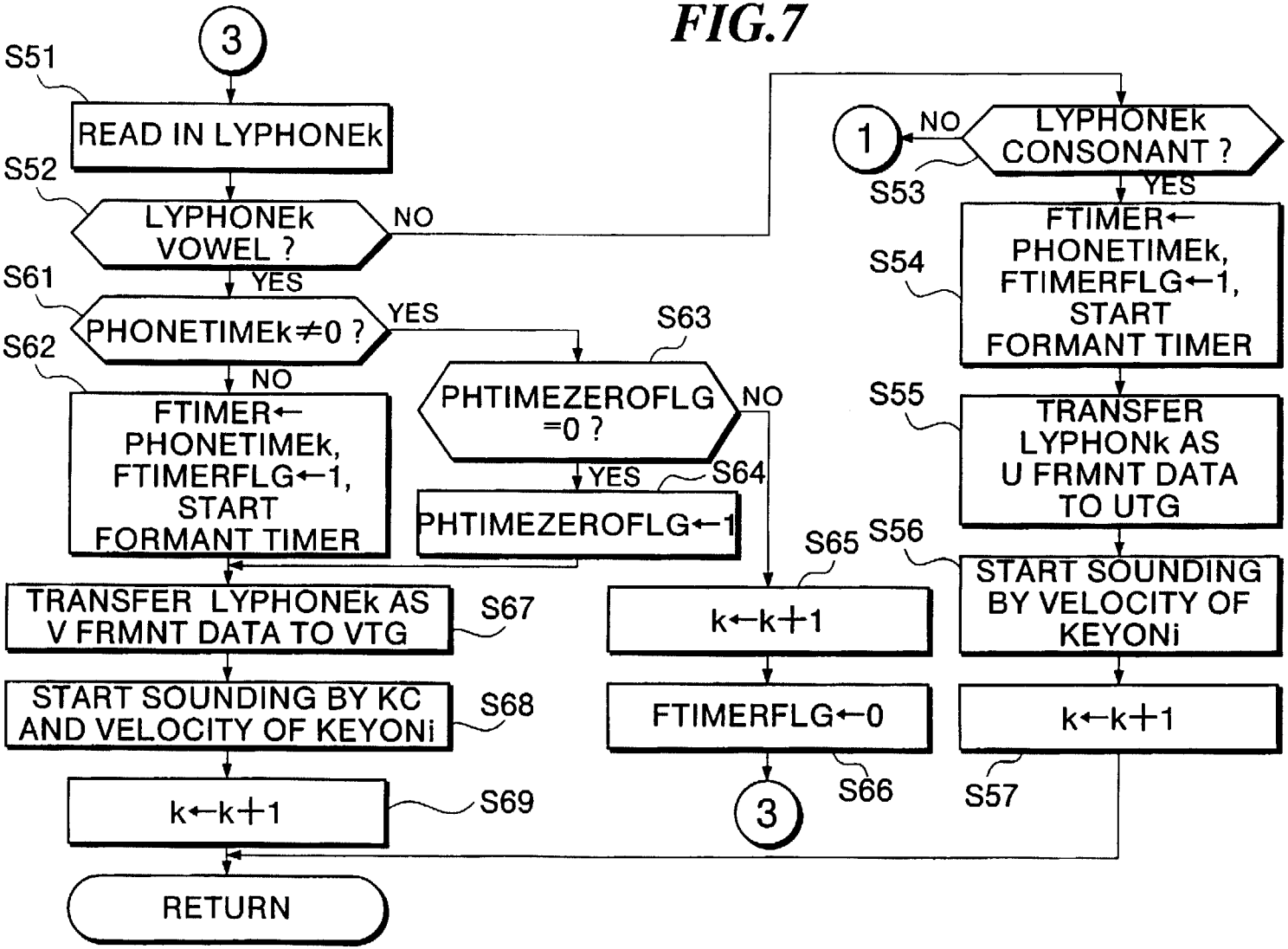
FIG. 7 is a flowchart showing a continued part of the FIG. 5 routine.

FIGS. 5 to 7 show a routine for the LYRIC SEQ DATA performance process executed at the step S21 in FIG. 4.

First, at a step S31, it is determined whether or not the key-on flag KEYONFLG assumes "0". When this step is first executed, KEYONFLG=0 holds, and then the program proceeds to a step S32, wherein an i-th lyric note data LYRIC NOTEi is read in. Then, it is determined at a step S33 whether or not the read data is end data LYRIC END. If the read data is end data LYRIC END, a LYRIC SEQ DATA performance-terminating process is executed at a step S36, followed by terminating the program, whereas if the read data is not end data LYRIC END, the duration data DURATION is converted to data indicative of a time period dependent on the tempo data TEMPO and the interrupt clock (specifically, a time interval for execution of a TIMER interrupt-handing routine shown in FIG. 8) and the resulting data is set to a note timer NOTETIMER. The value or count of the note timer is decremented by "1" whenever the FIG. 8 routine is executed.

At the following step S35, a pointer k is set to "1", and at the same time the key-on flag KEYOMFLG and the note-on flag NOTEONFLG are both set to "1", followed by the program proceeding to a step S41 in FIG. 6. At the step S41, it is determined whether or not the rest process flag RESTFLG assumes "0". When this step is first executed, RESTFLG=0 holds, and then the program proceed to a step S42, wherein it is determined whether or not the note-on flag NOTEONFLG assumes "1". The note on flag NOTEONFLG is reset from "1" to "0" when the duration has elapsed and the note time NOTETIMER is decreased to "0" (at steps S73 and S74 in FIG. 8). When the step S42 is first executed, however, NOTEONFLG=1 holds, and then the program proceeds to a step S43.

At the step S43, it is determined whether or not the zero designation flag PHTIMERZEROFLG assumes "0". When this step is first executed, PHTIMERZZEROFLG=0 holds, and then the program proceeds to a step S44, wherein it is determined whether or not the formant timer flag FTIMERFLG assumes "0". When this step is first executed, FTIMERFLG=0 holds, and then the program proceeds to a step S51 in FIG. 7, wherein phoneme code data LYPHONE indicated by the pointer k is read in. Then, it is determined at a step S52 whether or not the read phoneme code data LYPHONE is data of a vowel, and if the read phoneme data is not data of a vowel, it is determined at a step S53 whether or not the read data is data of a consonant.

For example, if the phoneme code data LYPHONE designates "h", the program proceeds through the steps S52 and S53 to a step S54. If both of the answers to the questions of the steps S52 and S53 are negative (NO), it is determined that sounding of one lyric note data LYRIC NOTE has been completed, and then the program proceeds to the step S48 in FIG. 6.

At the step S54, the formant timer FTIMER is set to the phoneme sounding time data PHONETIME indicated by the pointer k, and at the same time the formant timer flag FTIMERFLG is set to "1" to thereby start the formant timer FTIMER. The formant timer FTIMER is decremented by the FIG. 8 routine, similarly to the note timer NOTEIMER, and when the count of the format timer FTIMFIL becomes equal to "0", the formant timer flag FTIMERFLG is set to "0" (steps S76 to S78).

At the following step S55, the phoneme code data LYPHONEk is transferred to the unvoiced sound formant-synthesizing tone generators UTG, and sounding of the phoneme is started at a velocity designated by the key-on data KEYON at a step S56. Then, the pointer k is incremented by "1" at a step S57, followed by terminating the program.

Figure 8:
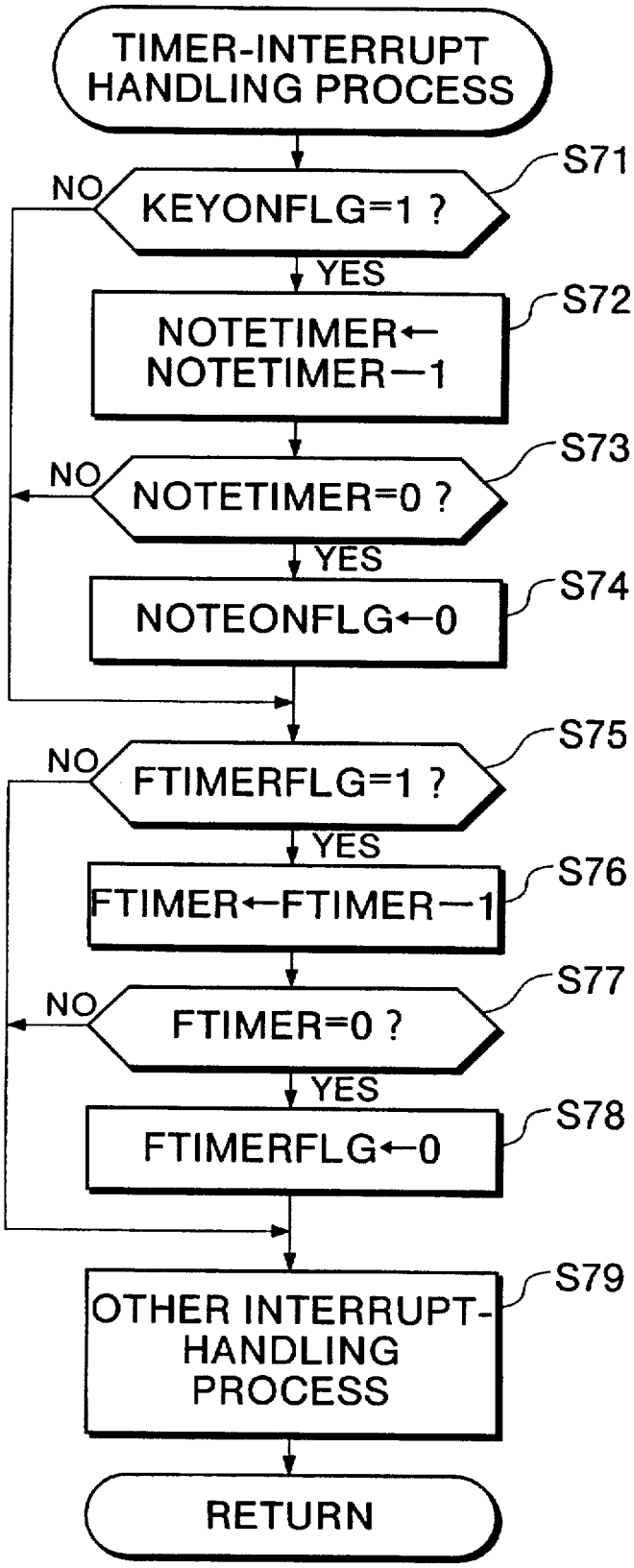
FIG. 8 is a flowchart showing a timer interrupt-handling routine.

Hereafter, the present routine is repeatedly immediately terminated following the execution of the step S44 until the count of the formant timer FTIMER and the count of the formant timer flag FTIMERFLG become equal to 0 by the FIG. 8 routine.

The timer interrupt-handling routine of FIG. 8 is executed at predetermined time intervals (e.g. whenever 8 milliseconds elapse). In this routine, first, at a step S71, it is determined whether or not the key-on flag KEYONFLG assumes "1". If KEYONFLG=0 holds, the program jumps to a step S75, whereas if KEYONFLG=1 holds, the count of the note-on timer NOTEON TIMER is decremented by "1" at a step S72, and it is determined at the step S73 whether or not the count of the timer is equal to "0". So long as NOTETIMER>0 holds, the program jumps to the step S75, whereas if NOTETIMER=0 holds, the note-on flag NOETONFLG is set to "0" at the step S74, and then the program proceeds to the step S75.

At the step S75, it is determined whether or not the formant timer flag FIMERFLG assumes "1". If FIMERFLG=0 holds, the program jumps to a step S79, whereas if FTIMERFLG=1 holds, the count of the formant timer FTIMER is decremented by "1" at the step S76, and then it is determined at the step S77 whether or not the count of the formant timer FTIMER is equal to "0". So long as FTIMER>0 holds, the program jumps to the step S79, whereas if FTIMER=0 holds, the formant timer flag FTIMERFLG is set to "0" at the step S78, and then the program proceeds to the step S79.

At the step S79, other interrupt-handling routines are carried out, followed by terminating the program.

In the above described manner, the FIG. 8 timer interrupt-handing routine controls the duration of the phonemes of the lyric note data and the sounding time period over which each of the phonemes is to be sounded.

Referring again to FIG. 6, when the formant timer flag FTIMERFLG becomes equal to "0", the program proceeds from the step S44 to the step S51, wherein the next phoneme code data LYPHONEk is read in.

Then, at the step S52, it is determined whether or not the read phoneme code data LYPHONEk is data of a vowel. If the phoneme code data LYPHONEk is data of a vowel (e.g. "i" in "hit"), it is determined at a step S61 whether or not the phoneme sounding time data PHONETIME designates a time period other than "0", i.e. whether or not the zero designation has been effected. If the zero designation has been effected (as in the case of "i" shown in FIG. 2F), the program proceeds to a step S63, wherein it is determined whether or not the zero designation flag PHTIMEZEROFLG assumes "0". When this step is first executed, PHTIMEZEROFLG=0 holds, the zero designation flag PHTIMERZEROFLG is set to "1"as a step S64, and then the program proceeds to a step S67. The vowel which is zero-designated continues to be sounded until the lapse of the duration, and hence setting of the formant timer FTIMER is not carried out.

On the other hand, if the zero designation has not been effected, the program proceeds to a step S62, wherein the formant timer FTIMER is set to the phoneme sounding time data PHONETIMEk indicated by the pointer k, and at the same time the formant timer flag FTIMERFLG is set to "1" to start the formant timer FTIMER, followed by the program proceeding to a step S67.

At the step S67, the phoneme code data LYPHONEME is transferred to the voiced sound formant-synthesizing tone generators VTG, and then sounding of the phoneme is started at a pitch and a velocity designated by the key-on data KEYON at a step S68, and the pointer k is incremented by "1" at a step S69, followed by terminating the program.

In the case of the lyric "hit" shown in FIG. 2F, the phoneme "i" is zero-designated, and hence, hereafter the present routine is repeatedly immediately terminated following the execution of the step S43. Then, when the duration elapses so that the note on timer NOTETIMER is decremented to "0", the program proceeds from the step S42 to the step S45, wherein it is determined whether or not the zero designation flag PHTIMEZEROFLG assumes "1". In the present example, PHTIMEZEROFLG=1 holds, so that the vowel ("i") being sounded is damped, and the rest process flag RESTFLG is set to "1" at a step S46, followed by the program proceeding to the step S51.

At the step S51, the next phoneme code data LYPHONE ("t") is read in, and the steps S52 to S57 are executed. Thereafter, the program repeatedly jumps from the step S41 to the step S44. When the count of the formant timer FTIMER becomes equal to "0" so that the formant timer flag FTIMER=0 holds, the program proceeds through the steps S51, S52 and S53 to the step S48, wherein the key-on flag KEYONFLG, the formant timer flag FTIMERFLG, the note-on flag FNOTEONFLG, the zero designation flag PHTIMEZEROFLG, and the rest process flag RESTFLG are all set to "0", and the pointer i is incremented by "1", followed by terminating the program.

In the case where the lyric note data LYRIC NOTE contains no phoneme which is zero-designated, when the duration elapses, the program proceeds from the step S45 to a step S47, wherein the vowel or consonant being sounded is damped, followed by the program proceeding to the step S48.

Further, in the case where one lyric note data LYRIC NOTE contains two or more phonemes which are zero-designated, the answer to the question of the step S63 in FIG. 7 becomes negative (NO), and then the program proceeds to a step S65, wherein the pointer k is incremented by "1", and then the formant timer flag FTIMERFLG is set to "0" at a step S66, followed by the program returning to the step S51. This prevents the second or later vowel which are zero-designated from being sounded.

Figure 9A:
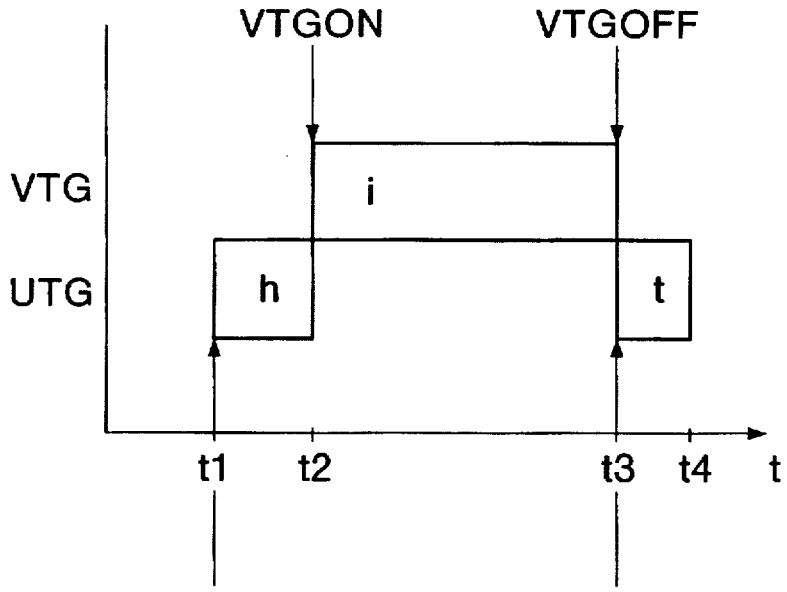
FIGS. 9A to 9C are diagrams which are useful in explaining the singing data performance process.
Figure 9B:
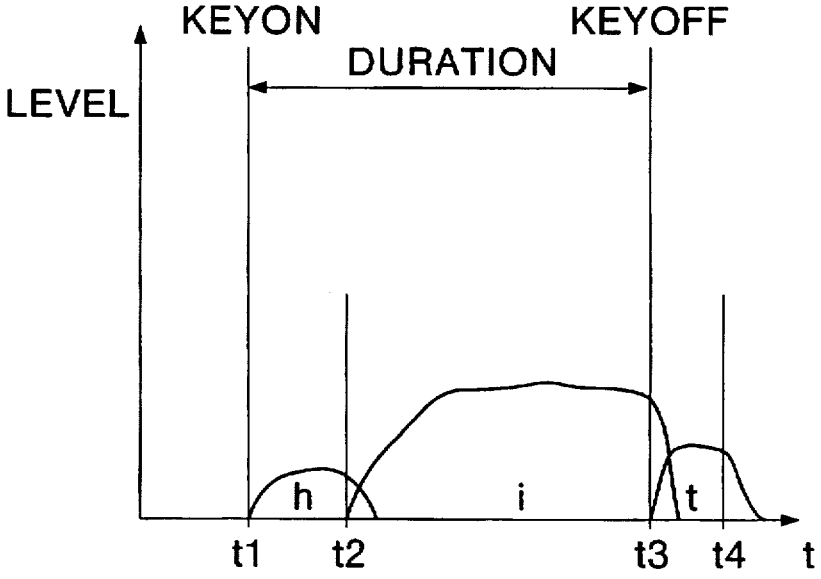
Figure 9C:
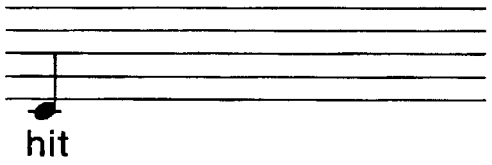

FIGS. 9A to 9C are diagrams useful in explaining the processing for sounding the lyric "hit", which has the phoneme sounding time data PHONETIME set as shown in FIG. 2F, on a manner corresponding to a quarter note at a pitch C3. As shown in the figures, sounding of the phoneme "h" is started at timing of key-on (time point t1), and when the sounding time period designated by the phoneme sounding time data PHONEMETIMEl has elapsed at a time point t2, sounding of the phoneme "i" is started, whereupon the level of the sounding of the phoneme "h"is damped according to a predetermined damping characteristic. Since the phoneme "i" is zero-designated, the sounding thereof is continued until the lapse of the duration designated by the duration data DURATION Itime point t3), and then the phoneme "t" is sounded over a sounding time period designated by the phoneme sounding time data PHONEMETIME3

In the case of the lyric "yuki" (at a lower portion of FIG. 2F), sounding of the vowel "u" which is zero-designated is continued up to a time point of the lapse of the duration, and the phonemes "k" and "i" are sounded thereafter.

As described above, according to the present embodiment, a vowel phoneme in the lyric note data LYRICS NOTE, which is zero-designated, is caused to be sounded until the duration of the lyric note data elapses, whereby a singing sound which is natural can be generated even when the tempo of the musical piece is changed.

Further, in the case where a long lyric is assigned to one note, the vowel which is zero-designated can be changed (e.g. from a sound "ko(–)nnichiwa" to a sound "konnichi (–)wa" in the case of a Japanese word "konnichiwa"), to thereby change the singing sound and thus widening the range of expression.

Now, a second embodiment of the invention will be described with reference to FIGS. 10 to 17.

Figure 10:
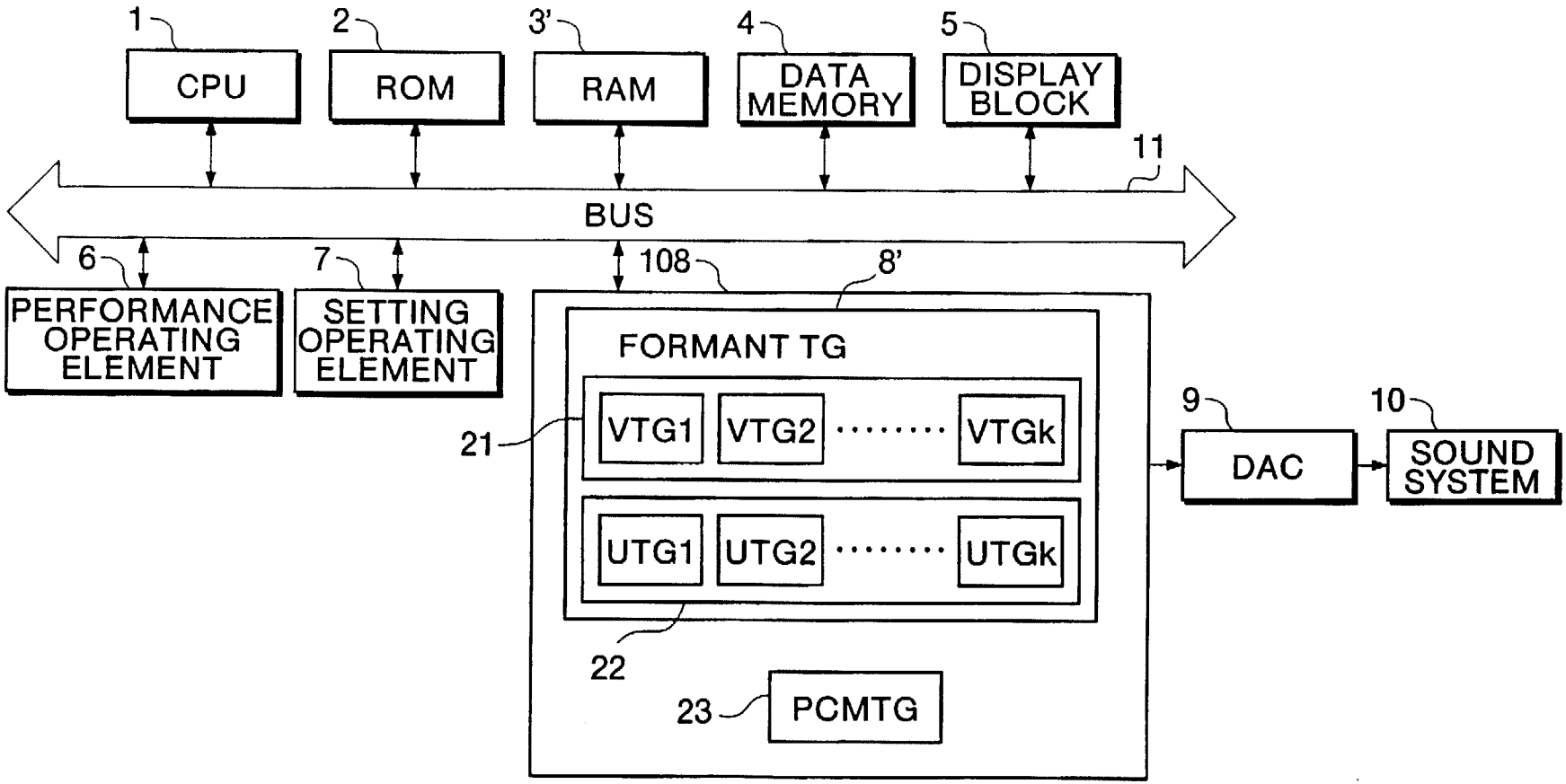
FIG. 10 is a block diagram showing the arrangement of an electronic musical instrument incorporating a singing sound-synthesizing apparatus according to a second embodiment of the invention.

FIG. 10 shows the arrangement of an electronic musical instrument incorporating a singing sound-synthesizing apparatus according to a second embodiment of the invention. Component parts and elements corresponding to those of the first embodiment are designated by identical numeral references, and detailed description thereof is omitted.

The tone generator 108 is comprised of a formant-synthesizing tone generator 8' similar to the formant-synthesizing tone generator 8 of the first embodiment, and a PCM tone generator PCM TG 23. Similarly to the first embodiment, the formant-synthesizing tone generator 8' has a voiced sound formant-synthesizing tone generator (VTG) group 21 which is comprised of a plurality of voiced sound formant-synthesizing tone generators VTG1 to VTGJ for generating respective voiced sound formant components having pitches, and an unvoiced sound formant-synthesizing tone generator (UTG) group 22 which is comprised of a plurality of unvoiced sound formant-synthesizing tone generators UTG1 to UTGk for generating noise-like components contained in a vowel and unvoiced sound formant components. Formant-synthesizing tone generators VTG's or UTG's corresponding to the formants of a phoneme to be sounded are used in combination to generate formant components for synthesization of a vocal sound. It should be noted that the voiced and unvoiced sound formant-synthesizing tone generators are also capable of generating musical sounds i.e. instrument sounds, and ones not assigned to channels for generating vocal sounds can be assigned to channels for generating musical sounds.

Figure 11:
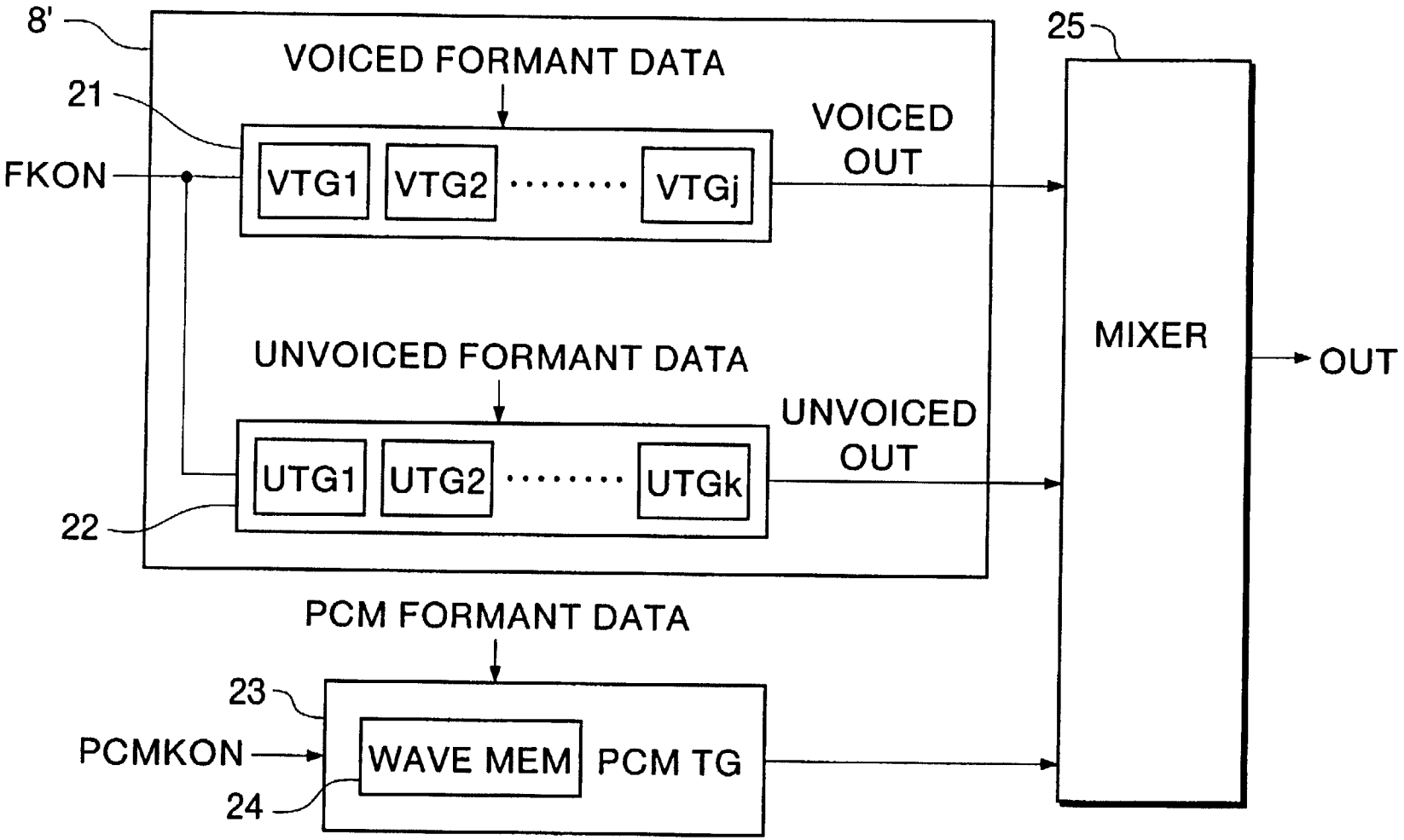
FIG. 11 is a block diagram showing the construction of a tone generator block appearing in FIG. 10.

FIG. 11 schematically shows the construction of the tone generator 108. The VTG group 21 is comprised of j formant-synthesizing tone generators VTGL to VTGJ, and the UTG group 21 is comprised of k formant-synthesizing tone generators UTG1 to UTGk. These formant-synthesizing tone generators have been proposed by the present assignee in Japanese Laid-Open Patent Publication (Kokai) No. 3-200300. They can be implemented by software, i.e. a tone-generating program executed by the CPU 1.

Each formant-synthesizing tone generator of the VTG group 21 is constructed as disclosed in Japanese Laid-Open Patent Publication (Kokai) No. 2-254497, and each formant-synthesizing tone generator of the UTG group 22 is constructed as disclosed in Japanese Laid-Open Patent Publication (Kokai) No. 4-346502.

The voiced sound formant-synthesizing tone generators VTG 1 to VTGJ (hereinafter simply referred to as "tone generators VTG1 to VTGj") of the VTG group 21 generate j respective formant component characteristics of a voiced sound to be generated, respectively. More specifically, the tone generators VTG1 to VTGJ start their respective operations in response to a formant-synthesizing start signal FKON supplied from the CPU 1, to control respective formant characteristics (particularly amplitude and frequency) of a voiced sound to be generated according to voiced sound formant data VOICED FOBMANT DATA supplied from the CPU 1, which includes data of a formant center frequency, data of a formant shape, data of a formant level, etc. Outputs from the tone generators VTG1 to VTGj are added together for synthesization of the respective output formant components to thereby generate formants of the voiced sound portion of the vocal sound to be generated. Further, the pitch of the voiced sound to be generated is controlled by controlling the pitch frequency of the outputs from the tone generators VTG1 to VTGJ.

On the other hand, the unvoiced sound formant-synthesizing tone generators UTG1 to UTGk (hereinafter simply referred to as "tone generators UTG1 to UTGk") of the UTG group 22 generate respective noise-like components and unvoiced sound formant components of the phoneme. More specifically, the tone generators UTG1 to UTGj start their respective operations in response to the formant-synthesizing start signal FKON supplied from the CPU 1, to impart respective band pass characteristics or formant characteristics to white noise generated by the tone generators according to parameters contained in unvoiced sound formant data UNVOICED FORMANT DATA supplied from the CPU 1. Outputs from the tone generators UTGl to UTGJ are added together for synthesization thereof to thereby generate noise-like components of the vocal sound to be generated and formants of the unvoiced sound portion of the vocal sound.

The PCM tone generator 23 includes a waveform memory 24 which stores waveforms of unvoiced sounds of consonants of a particular singer. The PCM tone generator 23 starts its operation in response to a PCM sound-synthesizing start signal PCMKON supplied from the CPU 1, and sequentially reads waveforms of unvoiced consonant sounds designated by PCM formant data PCM FORMANT DATA read from the waveform memory 24 at designated timing to thereby reproduce waveforms of the unvoiced consonant sounds.

Outputs from the VTG group 21, the UTG group 22, and the PCM tone generator 23 are added together by a mixer 25 which outputs the resulting sum.

In general, the parameters (VOICED FORMANT DATA and UNVOICED FORMANT DATA) supplied to the tone generators of the VTG group 21 and the UTG group 22 are obtained by analyzing waveforms of natural vocal sounds actually generated by a human being.

In the present embodiment, as parameters related to unvoiced consonants, waveforms of natural vocal sounds are directly stored in the waveform memory 24 of the PCM tone generator 23, and parameters obtained by analyzing the stored waveforms of natural vocal sounds are stored in a dictionary (phoneme data base, referred to hereinafter). As parameters related to other phonemes (vowels and voiced consonants), parameters obtained by analyzing waveforms of natural vocal sounds are stored in the dictionary without directly storing the waveforms of natural vocal sounds.

To synthesize a vocal sound which is natural, e.g. such a sound that the phoneme being sounded shifts from a consonant to a vowel, it is important to continuously change formants to be generated. Therefore, according to the present embodiment, parameters, such as formant center frequency, formant level, formant bandwidth, and pitch frequency are sequentially delivered from the CPU 1 at predetermined time intervals (e.g. time intervals of several milliseconds) to control the synthesization, or the parameters are sequentially controlled or changed by envelope generators incorporated in the tone generators of the VTG and UTG groups to control the synthesization.

In the present embodiment, the waveforms of natural vocal sounds are directly stored in the waveform memory 24 as parameters related to unvoiced consonants, as mentioned above, each unvoiced consonant is sounded by reading a waveform sample from the waveform memory and delivering it from the PCM tone generator 23 as it is, while the parameters obtained by analyzing the above waveform sample are used by the unvoiced sound formant-synthesizing tone generators of the UTG group 22 to generate the unvoiced consonant at the same time. However, the output level of the unvoiced consonant generated by the UTG group 22 is set to "0" to prevent the unvoiced consonant from being actually outputted. Further, according to a transition of formant frequencies from the unvoiced consonant to the following voiced sound (vowel), the VTG group 21 starts to generate formants of the following voiced sound. Therefore, at a junction between the preceding phoneme and the following phoneme, the unvoiced consonant generated by the PCM tone generator 23 and the following phoneme or vowel generated by the VTG group 21 are mixed or superposed one upon the other, whereby a smooth transition from the consonant to the vowel can be realized and a high-quality unvoiced consonant can be generated.

Now, shifting of formants during sounding of a musical sound will be described in detail with reference to a timing chart shown in FIG. 12.

Figure 12:
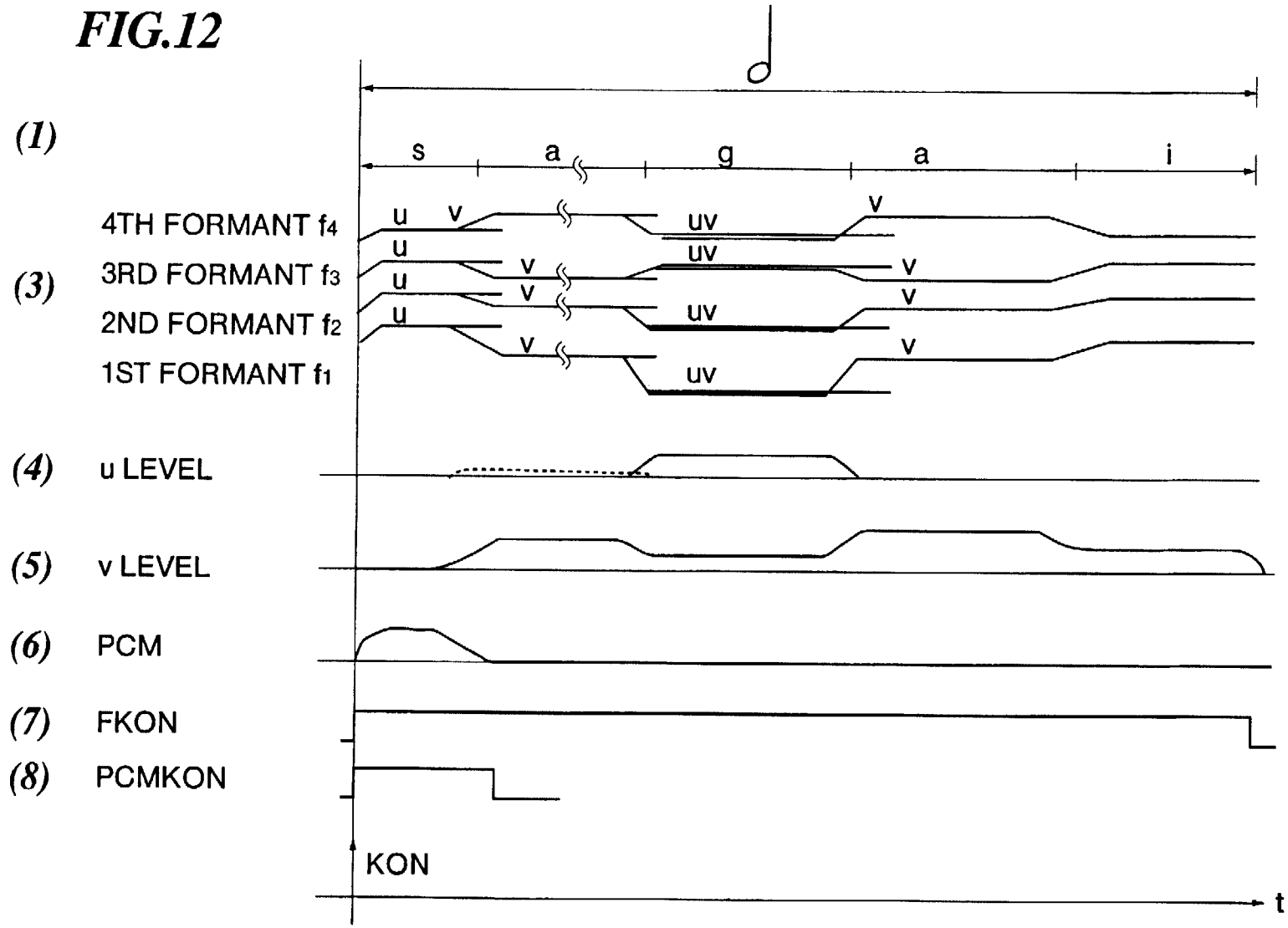
FIG. 12 is a timing chart which is useful in explaining the operation of the singing sound-synthesizing apparatus.

In FIG. 12, the abscissa designates time, and FIG. 12 shows shifts of the formant frequencies and formant output levels occurring when a vocal sound "sagai" is generated in a manner corresponding to one musical note, i.e. a half note in the present case. In the illustrated example, it is assumed that the VTG group 21 and the UTG group 22 each have four formant frequencies f1 to f4.

In the figure, (1) designates a time period corresponding to the half note, (2) sounding time periods over which the phonemes are respectively sounded, (3) shifts of the four formant frequencies f1 to f4 of the voiced and unvoiced sound formants of each of the phonemes, where v designates a voiced sound formant, and u an unvoiced sound formant. Further, (4) designates the output level of the unvoiced sound formants from the UTG group 22, and (5) the output level of the voiced sound formants from the VTG group 21. (6) designates a waveform of a phoneme delivered from the PCM tone generator 23. Further, (7) designates the formant-synthesizing start signal FKON (hereinafter referred to as "the FKON signal") for instructing the VTG group 21 and the UTG group 22 to start generation of formants, and (8) the PCM sound-synthesizing start signal PCMKON (hereinafter referred to as "the PCMFKON signal") for instructing the PCM tone generator to start generation of a PCM sound. It should be noted that although the PCMKON signal continues to be on during sounding of an unvoiced consonant in the figure, this is not limitative, but as the PCMKON signal, a short pulse signal may be used, which also serves as a trigger for starting the reading of a waveform sample from the waveform memory and causing the entire waveform sample to be read from the waveform memory in response to the trigger.

Now, to sound the phonemes "sagai" in a manner corresponding to the half note, as shown in FIG. 12, first, the FKON signal of (7) and the PCMFKON signal of (8) are generated in response to a key-on (KON) signal. Responsive to these signals, the VTG group 21, the UTG group 22 and the PCM tone generator 23 start to operate. To generate the unvoiced consonant "s" as the first phoneme, a waveform sample of the phoneme "s" is read from the waveform memory of the PCM tone generator 23, and delivered as shown in (6) of the figure. During this processing, also the UTG group 22 carries out processing for sounding the unvoiced consonant "s" by generating the first to fourth formant frequencies f1 to f4 set to respective predetermined frequencies as shown in (3) of the figure. However, the output level of the UTG group 22 is set to "0" as shown in (4), and therefore no phoneme is outputted from the UTG group 22. Further, during this time period, formants are not generated from the tone generators of the VTG group, i.e. the output level of the VTG group 21 is also set to "0", as shown in (5).

Then, when the sounding of the phoneme "s" comes close to an end and the time for transition of formant frequencies from the phoneme "s" to the following phoneme "a" has come, the VTG group 21 start to generate formant frequencies so as to cause a shift of the phoneme to be sounded from the preceding phoneme "s" to the following phoneme "a", and the output level v from the VTG group 21 progressively rises as shown in (5).

Then, when the sounding of the phoneme "s" comes to an end and the time for sounding the phoneme "a"alone has come, the PCMKON signal shown in (8) is set to a low level, whereby the operation of the PCM tone generator is stopped. Further, as shown in (3), the generation of formants by the UTG group 22 is stopped, and the first to fourth formant frequencies are generated by the VTG group 21 alone. During this time period, the output level v from the VTG group 21 is set to a large value as shown in (5). If the phoneme to be sounded this time contains noise-like components, formants may be also generated from the UTG group 22 and mixed with or superposed on the phoneme generated by the VTG group 21, as indicated by a broken line in (4).

When the sounding of the phoneme "a" comes closer to an end, the UTG group 22 start to generate formant frequencies so as to cause a shift from the phoneme "a" to the phoneme "g". At this time, as shown in (4), the output level u of the UTG group 22 starts to rise. Correspondingly to this rise, the output level v of the VTG group 21 starts to be progressively lowered, as shown in (5).

When the transition from the phoneme "a" to the phoneme "g" has been completed and the time for sounding the phoneme "g" alone has come, the UTG group 22 generate formant frequencies for sounding the phoneme "g". The phoneme "g" contains not only an unvoiced component but also a voiced component, and hence the VTG group 21 also generate formant frequencies peculiar to the phoneme "g". That is, during this time period, as shown in FIG. 12, both the VTG group 21 and the UTG group 22 generates the voiced sound component of the phoneme "g" and the unvoiced sound component of the same, respectively. Further, during this time period, the output level u of the UTG group is set to a high level as shown in (4), and the output level v of the VTG group 21 is also set to a predetermined level as shown in (5).

As the sounding of the phoneme "g" comes closer to an end, the formant frequencies f1 to f4 of the VTG group 21 are changed so as to cause a transition from the phoneme "g" to the phoneme "a", while the output level u of the UTG group 22 is progressively decreased and the output level v of the VTG group 21 is progressively increased, as shown in (3).

Then, when the sounding of the phoneme "g" has been terminated and the time for sounding the phoneme "a" alone has come, the generation of formant frequencies by the UTG group 22 is stopped, and the tone generators of the VTG group 21 start to generate first to fourth formant frequencies corresponding to the phoneme "a". Correspondingly to this, the output level u of the UTG group 21 is damped, while the output level v of the VTG group 22 is set to a high level.

Subsequently, when the time for transition from the phoneme "a" to the phoneme "i" has come, the formant frequencies f1 to f4 of the VTG group 21 are changed such that a smooth transition takes place from the phoneme "a" to the phoneme "i" in a coarticulated manner. Further, the output level v of the VTG group 21 is also changed from one corresponding to the phoneme "a" to one corresponding to the phoneme "i".

Then, when the time for generating the phoneme "i"alone has come, the first to fourth formant frequencies peculiar to the phoneme "i" are generated in a stable or constant manner by the tone generators of the VTG group 21, and at the same time the level v of the VTG group 21 is set to a constant level.

Then, when the time period for sounding of the musical note shown in (1) of FIG. 12 comes to an end, the FKON signal is set to a low level as shown in (7), and the output level v of the VTG group 21 is damped to a zero level along a predetermined damping curve, as shown in (5). Thus, the sounding of the phonemes corresponding to the musical note is completed.

In the above described manner, according to the present embodiment, the voiced sound formant-synthesizing tone generator group 21, the unvoiced sound formant-synthesizing tone generator group 22, and the PCM sound tone generator 23 are used to generate phonemes corresponding to a musical note.

Figure 13A:
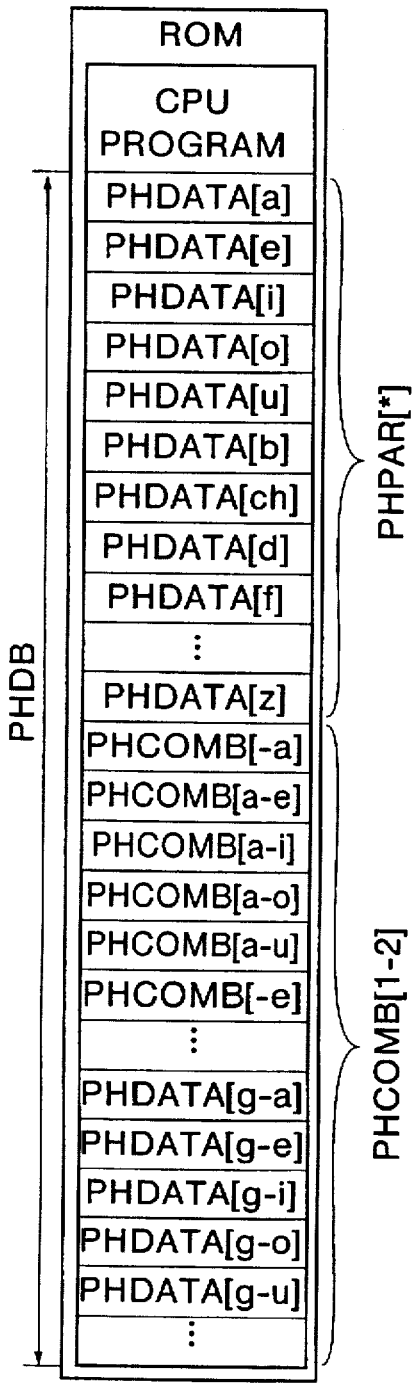
FIGS. 13A to 13C are diagrams showing data formats of parameters stored in a data base.

Next, various kinds of data used by the singing sound-synthesizing apparatus of the present embodiment for executing operations described above will be described. FIG. 13A shows an example of memory map of the ROM 11. As shown in the figure, the ROM 11 stores programs executed by the CPU and the phoneme data base PHDB. An area for the programs executed by the CPU stores various programs, such as a control program for control of the whole apparatus and a program for executing a singing sound-generating process described hereinafter.

The phoneme data base PHDB is comprised of a phone data block and a coarticulation block. The phoneme data block stores various phoneme parameter sets PHPAR[*] for synthesizing respective phonemes (vowels and consonants), and the coarticulation block stores various coarticulation parameter sets PHCOMB[1–2] for effecting coarticulation at a transition from an unvoiced sound to a voiced sound or from a voiced sound to an unvoiced sound (particularly, transition in formant frequencies), for respective combinations of a preceding phoneme and a following phoneme.

Figure 13B:
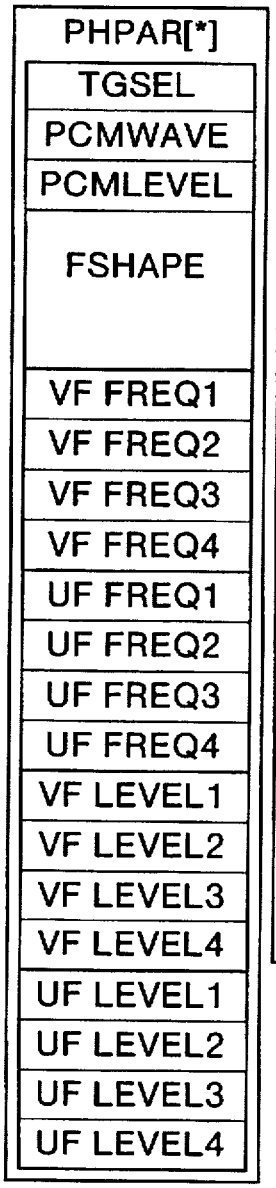

FIG. 13B shows a data format of a phoneme parameter set PHPAR[*]. As shown in the figure, the phoneme parameter set PHPAR[*] is comprised of a parameter (tone generator-designating data) TGSEL for designating a tone generator depending upon whether the PCM tone generator should be used or the formant-synthesizing tone generators should be used to sound a phoneme, a parameter (waveform-designating data) PCMWAVE for designating a waveform sample corresponding to a phoneme when the PCM tone generator is used for sounding the phoneme, a parameter (PCM level data) for designating the output level of the PCM tone generator when the PCM tone generator is used, a parameter (formant shape data) FSHAPE for designating the shape of each formant for sounding the phoneme, voiced sound first to fourth formant center frequencies VF RREQ1 to VF FREQ4 for designating center frequencies of the first to fourth voiced sound formants, unvoiced sound first to fourth formant frequencies UF RREQ1 to UF FREQ4 for designating center frequencies of the first to fourth unvoiced sound formants, voiced sound first to fourth formant levels VF LEVEL1 to VF LEVEL4 for designating the output levels of the first to fourth formants of the voiced sound, and unvoiced sound first to fourth formant levels UF LEVEL1 to UF LEVEL4 for designating the output levels of the first to fourth formants of the unvoiced sound. The phoneme parameter sets PHPAR[*] are stored separately for respective phonemes.

Figure 13C:
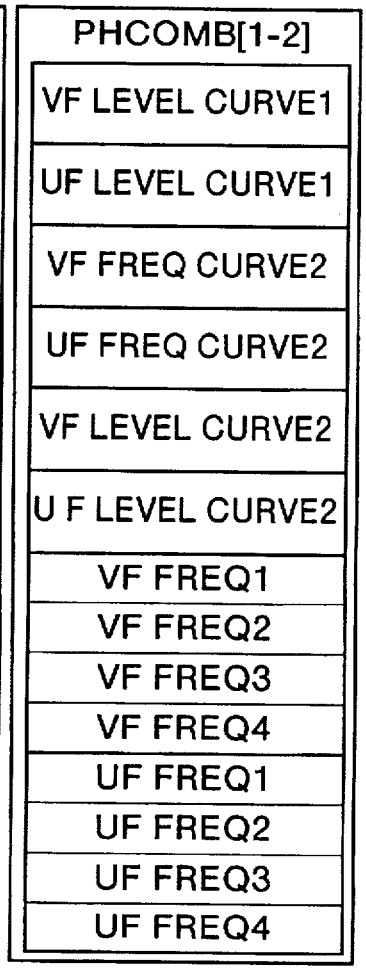

FIG. 13C shows a data format of a coarticulation parameter set PHCOMB[1–2], which represents characteristics of change of formants from a preceding phoneme 1 to a following phoneme 2. As shown in FIG. 13C, the coarticulation parameter set PHCOMB|1–2| is comprised of a parameter VF LEVEL CURVE 1 indicative of a preceding phoneme voiced sound amplitude decreasing characteristic which defines how the preceding phoneme as a voiced sound should decrease in amplitude, a parameter UF LEVEL CURVE1 indicative of a preceding phoneme unvoiced sound amplitude decreasing characteristic which defines how the preceding phoneme as an unvoiced sound should decrease in amplitude, a parameter VF FREQ CURVE2 indicative of a following phoneme voiced sound formant frequency varying characteristic which defines how the formant frequencies of the following phoneme as a voiced sound should change during the transition, a parameter UF FREQ CURVE2 indicative of a following phoneme unvoiced sound formant frequency varying characteristic which defines how the formant frequencies of the following phoneme as an unvoiced sound should change during the transition, a parameter VF LEVEL CURVE2 indicative of a following phoneme voiced sound output level rising characteristic which defines how the output level of the following phoneme as a voiced sound should rise, a parameter UF LEVEL CURVE2 indicative of a following phoneme unvoiced sound output level rising characteristic which defines how the output level of the following phoneme as an unvoiced sound should rise, parameters VF INIT FREQ1 to VF INIT FREQ4 and UF INIT FREQ1 to UF INIT FREQ4 indicativE of first to fourth formant initial center frequencies of respective voiced and unvoiced sounds, each applied when a voiced or unvoiced sound rises from a silent state.

When no phoneme name is indicated before the hyphen within the bracket as in PHCOMB|–a|, it means that there is no preceding phoneme and the phoneme "a"suddenly starts to be sounded from a silent state. In such a case, one of the parameters VF INIT FREQ1 to VF INIT FREQ4 or UF INIT FREQ1 to UF INIT FREQ4 is used, while the parameter VF LEVEL CURVE1 indicative of the preceding phoneme voiced sound amplitude decreasing characteristic and the parameter UF LEVEL CURVE1 indicative of the preceding phoneme unvoiced sound amplitude decreasing characteristic are ignored.

Figures 14A, 14B:
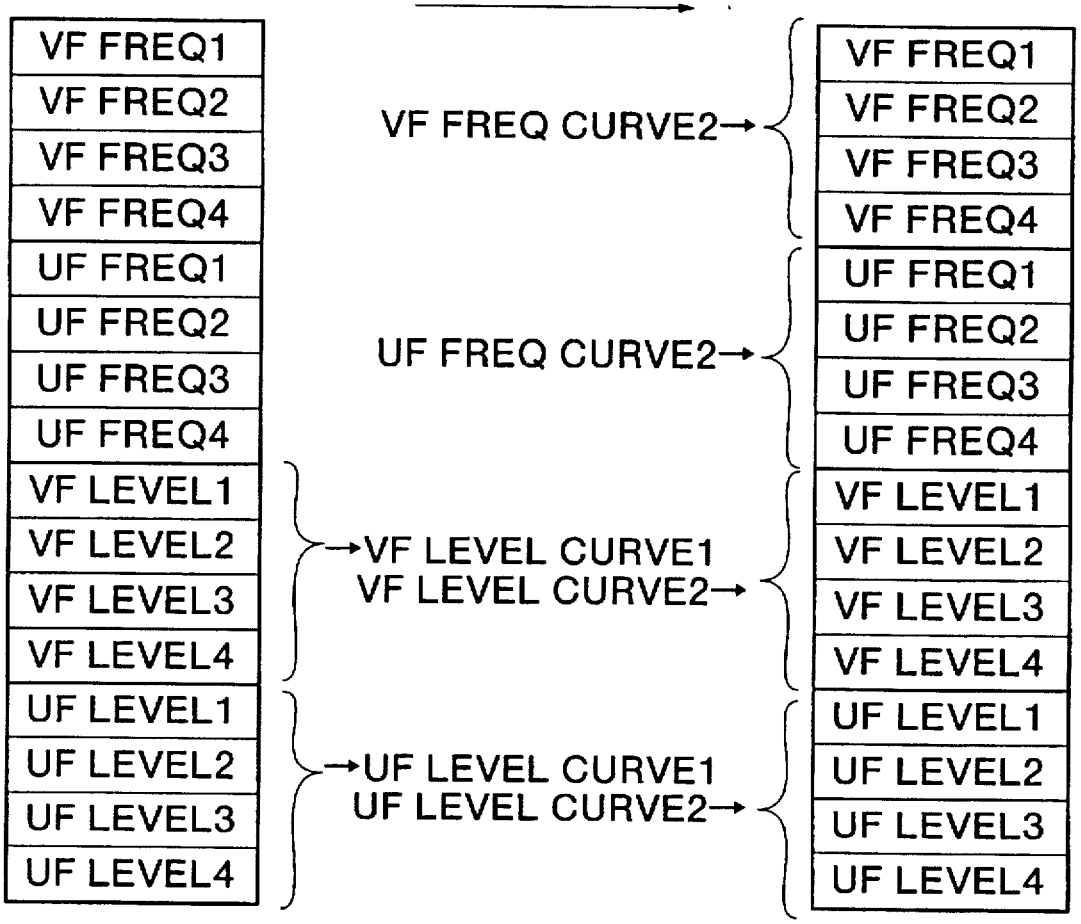
FIGS. 14A and 14B are diagrams which are useful in explaining a transition from a preceding phoneme to a following phoneme.

FIGS. 14A and 14B show how the coarticulation parameter set PHCOMB|1–2| is used during a transition from a preceding phoneme to a following phoneme. FIG. 14A shows parameters related to the preceding phoneme which are comprised of the first to fourth formant frequencies VF FREQ1 to VF FREQ4, the voiced sound first to fourth formant levels VF LEVEL1 to VF LEVEL4, the unvoiced sound first to fourth formant frequencies UF FREQ1 to UF FREQ4, and the unvoiced sound first to fourth formant levels UF LEVEL1 to UF LEVEL4.

To cause a transition from the preceding phoneme to the following phoneme, if the preceding and following phonemes are both voiced sounds, the voiced sound formant center frequencies of the preceding phoneme are changed from the voiced sound first to fourth formant center frequencies VF FREQ1 to VF FREQ4 of the preceding phoneme to those VF FREQ1 to VF FREQ4 of the following phoneme along a curve designated by the parameter VF FREQ CURVE2 of the coarticulation parameter set PHCOM |1–2|. Similarly, if the preceding and following phonemes are both unvoiced sounds, the unvoiced sound formant center frequencies of the preceding phoneme are changed from the invoiced sound first to fourth formant center frequencies UF FREQ1 to UF FREQ4 of the preceding phoneme to those UF FREQ1 to UF FREQ4 of the following phoneme along a curve designated by the parameter UF FREQ CURVE2 of the coarticulation parameter set PHCOM |1–2|.

The voiced sound formant levels of the preceding phonemes are decreased from the voiced sound first to fourth formant levels VF LEVEL1 to VF LEVEL4 of the preceding phoneme along a curve designated by the parameter VF LEVEL CUEVE1 of the coarticulation parameter set PHCOMB|1–2| in the case of the preceding phoneme being a voiced sound. Similarly, the unvoiced sound formant levels of the preceding phoneme are decreased from the unvoiced sound first to fourth formant levels UF LEVEL1 to UF LEVEL4 of the preceding phoneme along a curve designated by the parameter UF LEVEL CURVE1 of the coarticulation parameter set PHCOMB|1–2| in the case of the preceding phoneme being an unvoiced sound.

On the other hand, the voiced sound formant levels of the following phoneme are increased to the voiced sound first to fourth formant levels VF LEVEL1 to VF LEVEL4 of the following phoneme along a curve designated by the parameter VF LEVEL CURVE2 of the coarticulation parameter set PHCOMB|1–2|, which is indicative of the voiced sound output level rising characteristic in the case of the following phoneme being a voiced sound. Similarly, the unvoiced sound formant levels of the following phoneme are increased to the unvoiced sound first to fourth formant levels UF LEVEL1 to UF LEVEL4 of the following phoneme along a curve designated by the parameter UF LEVEL CURVE2 of the coarticulfition parameter set PHCOMB |1–2|, which is indicative of the unvoiced sound output level rising characteristic in the case of the following phoneme being an unvoiced sound.

Thus, the preceding phoneme 1 and the following phoneme 2 are smoothly coarticulated by the use of the coarticulation parameter set PHCOM|1–2|.

Figure 15A:
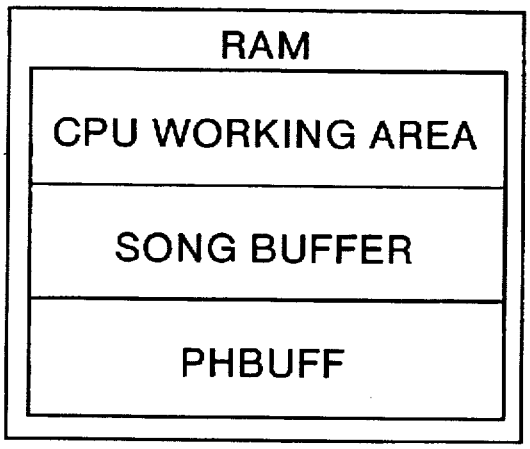
FIG. 15A is a diagram showing areas of a RAM 3' appearing in FIG. 10.
Figure 15B:
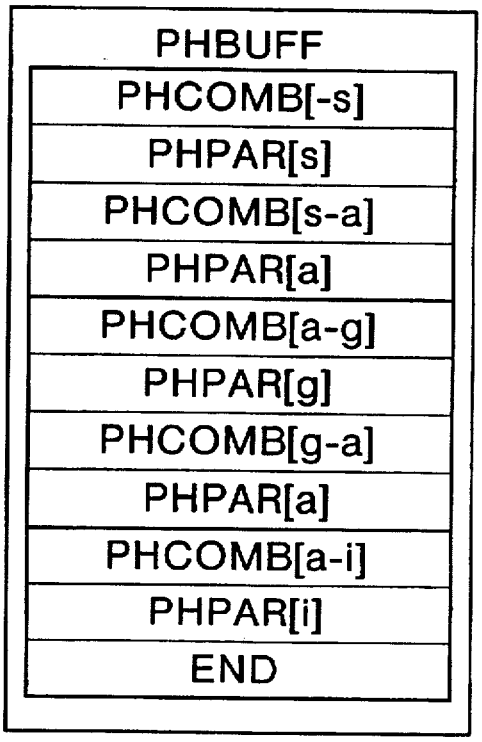
FIG. 15B is a diagram showing an example of data stored in a phoneme buffer of the RAM 3'.

FIG. 15A shows an example of the memory map of the RAM 3'. As shown in the figure, the RAM 3' has a working area used by the CPU 1 for calculation, a song buffer into which are loaded song data, and a phoneme buffer PHBUFF into which phoneme data are loaded for generating phonemes corresponding to one musical note. FIG. 15B shows an example of phoneme data stored in the phoneme buffer PHBUFF for sounding phonemes "sagai". As shown in the figure, the phoneme buffer PHBUFF is loaded with or temporarily stores coarticulation parameter sets PHCOMB |1–2| and phoneme parameter sets PHPAR|*| for phonemes to be sounded during a time period corresponding to one musical note, which are alternately arranged in the buffer PHBUFF.

The coarticulation parameter sets and phoneme parameter sets stored in the phoneme buffer PHBUFF are supplied to the tone generators VRG1 to VTG 4 of the VTG group 21 and the tone generators UTG1 to UTG4 of the UTG group 22 for sounding respective corresponding phonemes.

The data memory 4 stores a plurality of song data SONGl to SONGn in a predetermined data format, similarly to the first embodiment as described with reference to FIGS. 2C and 2D. Each of the song data is comprised, similarly to the first embodiment, song name data SONGNAME indicative of the name of a song, tempo data TEMPO indicative of the tempo of the musical piece, other data MISC DATA indicative of the meter, timbre, etc., singing data LYRIC SEQ DATA used for synthesization of a singing sound, and accompaniment data ACCOMP DATA for performance of accompaniment.

Figure 16A:
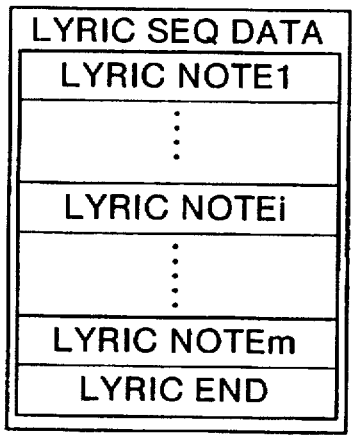
Figure 16B:
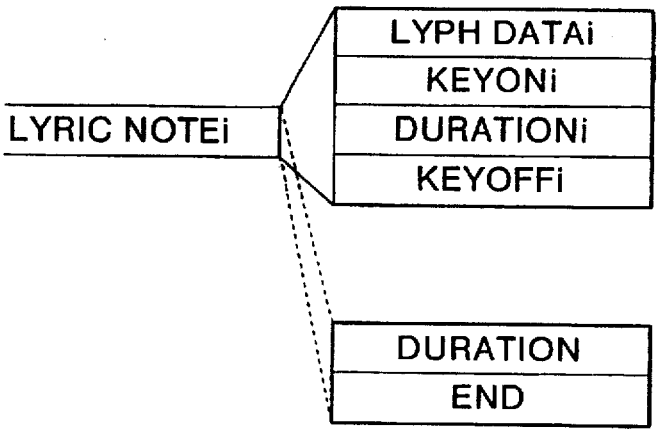

FIGS. 16A to 16E show a data format of singing data LYRIC SEQ DATA. As shown in FIG. 16A, the singing data LYRIC SEQ DATA is comprised of m lyric note data LYRIC NOTE1 to LYRIC NOTEm corresponding to each musical note of a song, and end data LYRICEND indicative of termination of the singing data. As shown in FIG. 16B, each lyric note data LYRIC NOTEi have different contents between a case where there is a lyric to be sounded during a time period corresponding to the musical note and a case where there is no such lyric. The lyric note data LYRIC NOTEi for a case where there is a lyric to be sounded is comprised of lyric phoneme data LYPH DATA, key-on data KEYON for designating the pitch and etc., duration data DURATION for designating a sounding time period corresponding to the musical note, and key-off data KEYOFF for designating termination of the sounding of the phonemes of the lyric data. The lyric note data LYRIC NOTEi for a case there is no lyric to be sounded is formed by the duration data DURATION, and an end code END designating the end of the lyric note data LYRIC NOTEi.

Figure 16C:
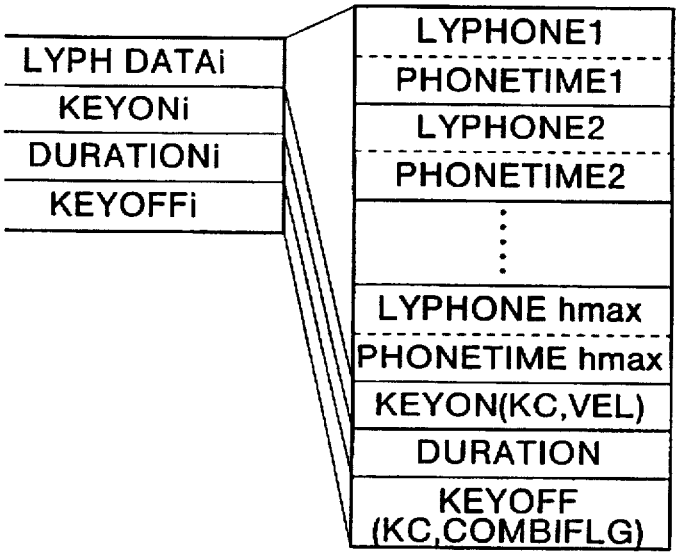

As shown in FIG. 16C, lyric note data LYRIC NOTEh used when there is a lyric to be sounded during a time period corresponding to the musical note is comprised of lyric phoneme data LYPH DATA formed of phoneme code data LYPHONE arranged in number corresponding to the number (hmax) of phonemes of the lyric to be sounded for designating respective ones of these phonemes and phoneme sounding time data PHONETIME associated with respective ones of the phoneme code data LYPHONE for designating sounding time periods over which respective corresponding ones of the phonemes are to be sounded, key-on data KEYON comprised of a key code or pitch data (C3 in an example shown in FIG. 16D) for the musical note and velocity data V (64 in the same), duration data DURATION (e.g. DUR 96 in the same) and key-off data KEYOFF including a coarticulation flag COMBIFLG which designates whether the last phoneme to be sounded for the present musical note and the first phoneme to be sounded for the following musical note are to be sounded in an coarticulated manner. It should be noted that when phoneme sounding time data PHONETIME is set to "1" or a larger value, it designates the sounding time period of the phoneme in terms of absolute time period which does not vary with the tempo of performance, etc., and when the same is set to "0", it designates that the sounding time period of the phoneme set to "0" is adjusted according to the sounding time period of the entire musical note designated by the duration data NOTEDUR. If all the phoneme sounding time data PHONETIME are set to "1" or larger values, each of the phonemes is sounded over a time period designated in terms of absolute time period by its corresponding phoneme sounding time data PHONETIME. The tone generator-designating data TGSEL of the phoneme parameter set PHPAR[*] may be included in the phoneme code data LYPHONE instead of being included in the phoneme parameter set.

FIG. 16D shows an example of lyric note data LYRIC NOTEi for sounding three phonemes "h", "i" and "t" (hmax=3). As shown in the figure, the musical note has a pitch of C3 and a velocity of 64, with a sounding time period for the musical note being set to 96 unit time periods (e.g. milliseconds). The phoneme sounding time data PHONETIME for the phonemes "h" and "t" are both set to 5 unit time periods, while one for the phoneme "i" is set to "0". Therefore, in this example, first, the phonempe"h" is sounded over five unit time periods, aind then the phoneme "i" is sounded over 86 (=96 (of DUR)−5 (of "h")−5 (of "t")) unit time periods, and finally the phoneme "t" is sounded over 5 unit time periods. When the phoneme "t" and the first phoneme of the next lyric note data LYRIC NOTEi+1 are to be sounded in a coarticulated manner, the coarticulation flag COMBIFLG of the key-off data is set.

FIG. 16E shows another example of lyrics note data LYRIC NOTEi for sounding five phonemes "s", "a", "g", "a" and "i" (hmax=5). As shown in the figure, the musical note has a pitch of A5 and a velocity of 85, with a sounding time period for the musical note being set to 127 unit time periods. In this example, the phoneme "s" is sounded over 5 unit time periods, the phoneme "a" is sounded over 32 (=127 (of DUR)−5 (of "s")−5 (of "g")−35 (of "a")−50 (of "i")) unit time periods, the phoneme "g" over 5 unit time periods, the phoneme "a" over 35 unit time periods, and the phoneme "i" over 50 unit time periods.

In the electronic musical instrument incorporating the singing sound-synthesizing apparatus thus constructed, when the operator selects a musical piece to be reproduced and starts the instrument to reproduce the musical piece, song data SONG corresponding to the selected musical note is selected out of the song data stored in the data memory 4 and transferred to the RAM 3'. Then, the CPU 1 determines the speed or tempo of performance based on the tempo data TEMPO contained in the song data SONG, and designates the timbre of a sound to be generated based on the other data MISC DATA contained in the same. Then, based on automatic accompaniment data contained in the accompaniment data ACCOMP DATA, a process for generating a musical sound of accompaniment is executed and at the same time, based on the singing data LYRIC SEQ DATA, a singing sound-generating process is executed.

Figure 17:
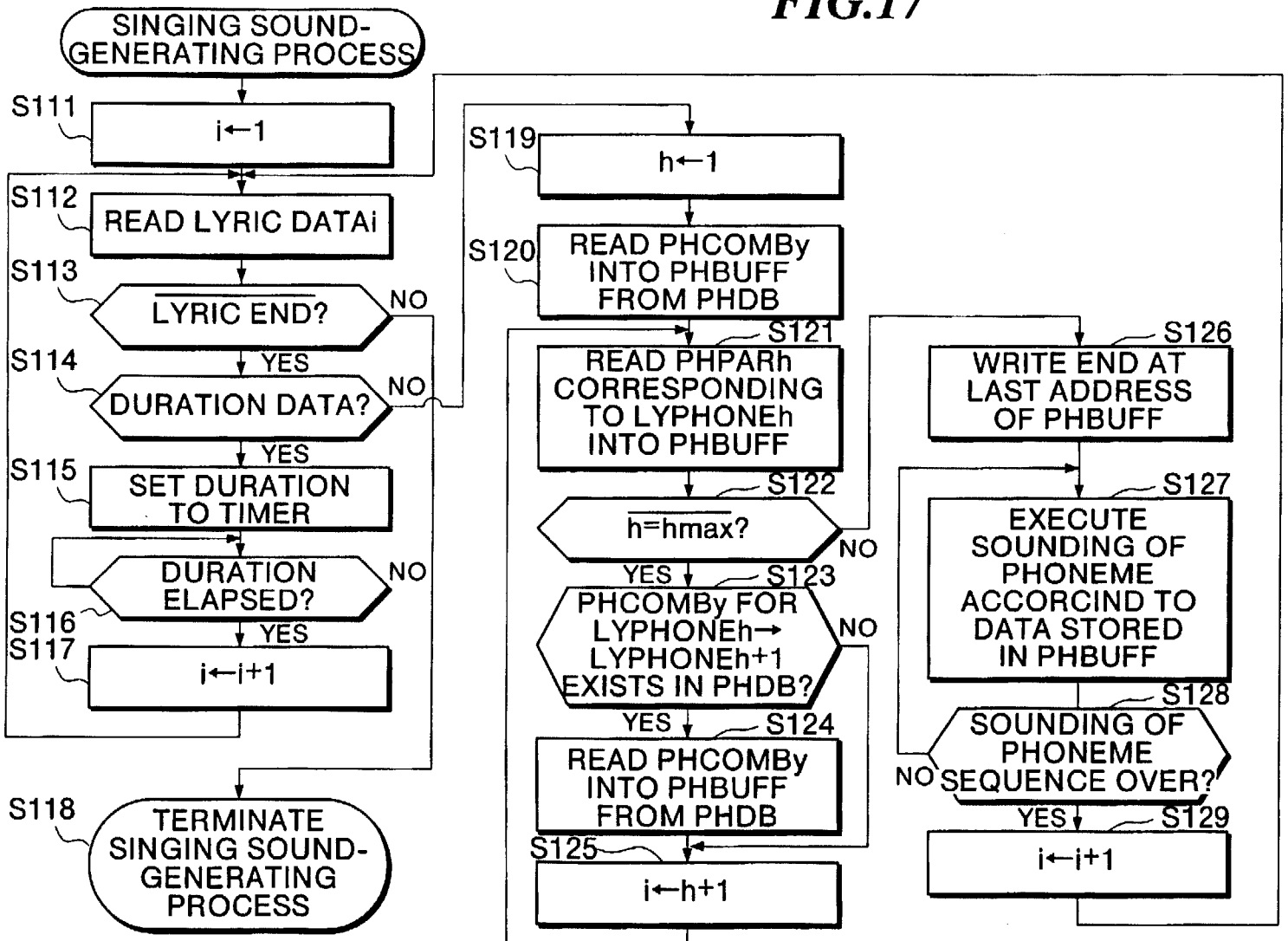
FIG. 17 is a flowchart showing a routine for executing a singing sound-generating process.

FIG. 17 shows a program for the singing sound-generating process executed by the CPU 1 of the electronic musical instrument. First, at a step S111, a pointer i for designating phonemes corresponding to a musical note is set to "1" for reading lyric note data LYRIC NOTE from the singing data LRYIC SEQ DATA. This designates lyric note data LYRIC NOTE corresponding to a first note of the singing data LYRIC SEQ DATA. The program proceeds to a step S112, wherein the first lyric note data LYRIC NOTE1 is read in. Then, it is determined at a step S113 whether or not the read data LYRIC NOTE1 is other than the end data LYRIC END indicative of an end of the lyric data.

In the present case, the lyrics note data LYRIC NOTE1 (i.e. LYRIC NOTEi=1) has been read in, and therefore it is determined that the read data LYRIC NOTE1 is other than the end data LYRIC END. Then, the program proceeds to a step S114, wherein it is determined whether or not the read data is the duration data DURATION. If the read data is the duration data DURATION, the value of the duration data DURATRION is set to a timer at a step S115, and then it is determined at a step S116 whether or not a time period (corresponding to the value of the duration data) set to the timer has elapsed. When the set time period has elapsed, the pointer i is incremented by "1" to a value of i+1 at a step S117, and then the program returns to the step S112, wherein the next lyric note data LYRIC NOTEi+1 is read in.

On the other hand, when the read lyric note data LYRIC NOTE is not the duration data DURATION, the program proceeds from the step S114 to a step S119, wherein a pointer h for designating phoneme data PHDATA is set to "1", to thereby designate first phoneme code data LYPHONE1 of the lyric note data LYRIC NOTE.

Then, the program proceeds to a step S120, wherein a coarticulation parameter set PHCOMBy corresponding to the coarticulation flag COMBIFLG of the key-off data of the immediately preceding lyric note data LYRIC NOTE read in and processed is read from the phoneme data base PHDB of the ROM 2 and written into the phoneme buffer PHBUFF. That is, when the coarticulation flag COMBIFLG of the key-off data KEYOFF of the immediately preceding lyric note data LYRIC NOTE has been set, the coarticulation parameter set PHCOMBy corresponding to phoneme code data LYPHONE hmax indicative of a last-sounded phoneme of the immediately preceding lyric note data LYRIC NOTE and the first phoneme code data LYPHONE1 of the present lyric note data LYRIC NOTE is read from the phoneme data base PHDB of the ROM 2 and written into the phoneme buffer PHBUFF. When the coarticulation flag COMBIFLG of the key-off data KEYOFF of the immediately preceding lyric note data LYRIC NOTE has not been set, a coarticulation parameter set PHCOMBy for sounding a phoneme designated by the phoneme code data LYPHONE1 of the present lyric note data LYRIC NOTE from a silent state is read and written into the phoneme buffer PHBUFF.

For example, if the present lyric note data LYRIC NOTE read at the present time is for sounding the phonemes "sagai" shown in FIG. 16D, and at the same time the coarticulation flag COMBIFLG of the immediately preceding lyric note data LYRIC NOTE has not been set, the coarticulation parameter set PHCOMB[-s] is written into a first address of the phoneme buffer PHBUFF of the RAM 3' at the step S120, as shown in FIG. 15B.

Then, the program proceeds to a step S121, wherein the phoneme code data LYPHONEh designated by the pointer h is referred to and a phoneme parameter set PHPARh corresponding thereto is read from the phoneme data base PHDB and written into the phoneme buffer PHBUFF. In the above example, as shown in FIG. 15B, the phoneme parameter set PHPAR[s] is read from the phoneme data base PHDB and written into a second address of the phoneme buffer PHBUFF.

Then, the program proceeds to a step S122, wherein it is determined whether or not the pointer h has reached the value hmax equal to the number of phonemes corresponding to the present musical note. If the pointer has not reached the value hmax, the program proceeds to a step S123, wherein it is determined whether or not a coarticulation parameter set PHCOMBy corresponding to the phoneme code data LYPHONEh and the next phoneme code data LYPHONEh+1 exists in the phoneme data base PHDB. If the coarticulation parameter set PHCOMBY corresponding to the phoneme code data LYPHONEh and the next phoneme code data LYPHONEh+1 does not exist in the phoneme data base PHDB, the program jumps to a step S125, whereas if the coarticulation parameter set PHCOMBy exists in the phoneme data base PHDB, the coarticulation parameter set PHCOMBy is read from the phoneme data base PHDB and written into the phoneme buffer PHBUFF. In the above example, as shown in FIG. 15B, a coarticulation parameter set PHCOMB[s–a] is written into the phoneme data base PHDB Then, the program proceed to the step S125, wherein the pointer h is incremented by "1" to a value of "h+1", and then the program returns to the step S121, wherein as described above, a phoneme parameter set PHPARh corresponding to the next phoneme code data LYPHONEh is read from the phoneme data base PHDB and written into the phoneme buffer PHBUFF.

Thus, the steps S121 to S125 are repeatedly executed until the pointer h reaches the value hmax, whereby ccarticulation parameter sets PHCOMBy and phoneme parameter sets PHPARh corresponding to the phoneme ccde data LYPHONE1 to LYPHONEh are read out and written into the phoneme buffer PHBUFF to be alternatively arranged therein. Thus, as shown in FIG. 15B, the phoneme data corresponding to the present note are written into and arranged in the phoneme buffer PHBUFF. The determination as to whether the pointer h has reached the value hmax can be carried out e.g. by reading data from an address corresponding to a value h+1 and determining that a condition of h=hmax is fulfilled if the read data is key-on data KEYON.

If it is determined at the step S122 that the pointer h has reached the value hmax, the program proceeds to a step S126, wherein the end data END is written into the phoneme buffer PHBUFF. Then, the program proceeds to a step S127, wherein data are read from the phoneme buffer PHBUFF starting with the first address thereof, and based on the read coarticulation parameter set PHCOMB and phoneme parameter set PHPAR, the VTG group, the UTG group or the PCMTG group designated by these parameters are operated to sound phonemes. During this processing, the pitch of a voiced sound to be generated is made to correspond to the key code KC of the key-on data and the sounding time period over which each phoneme is sounded is controlled by the duration data DURATION of the musical note or the phoneme sounding time data PHONETIME.

This step S127 is repeatedly executed until the sounding of all the phonemes corresponding to the i-th lyric note data LYRIC NOTEi is completed (S128). When the end data END is read from the phoneme buffer PHBUFF, the pointer i for reading lyric note data LYRIC NOTE is incremented by "1" to a value of "i+1" at a step S129, and then the program returns to the step S112. Thus, the reading of singing data LYRIC SEQ DATA and the sounding process based thereon are repeatedly executed, and when the end data LYRIC END of the singing data LYRIC SEQ DATA is read from the phoneme buffer PHBUFF, the answer to the question of the step S113 becomes negative (NO), and then the singing sound process is terminated at a step S118.

A plurality of sets of combinations of data of PCM waveforms and data obtained by analyzing the PCM waveforms may be prepared, e.g. for respective different singers so that these sets of combinations of data are selected for synthesizing unvoiced sounds, depending upon singers, which facilitates changing the tone quality.

Further, it is not required to synthesize all the unvoiced consonant sounds using PCM waveforms, but unvoiced consonant sounds which can be synthesized to a certain degree of quality by the formant synthesization method may be synthesized by the formant synthesization method. To synthesize voiced explosive sounds, separate PCM waveforms of unvoiced sounds and PCM waveforms voiced sounds should be preferably used, but all the consonants may be synthesized by the use of PCM waveforms.

Further, to synthesize noise-like components of voiced sounds which have formants thereof not largely changed, looped PCM waveforms may be used to synthesize the same.

Further, the PCM waveform of each consonant to be generated by the PCM tone generator may be varied depending on the kind, pitch or volume of a voiced sound which follows the consonant.

The singing sound-synthesizing apparatus of the present invention can be preferably applied e.g. to electronic musical instruments and computer systems, audio or voice response units, or amusement machines, such as game machines and karaoke systems insofar as they can generate singing sounds.

Further, the singing sound-synthesizing apparatus of the present invention may be realized by software for computer systems, typically by personal computers. In such a case, the synthesization of vocal sound waveforms may be carried out by the CPU, or otherwise, as shown in FIG. 10, a tone generator may be additionally provided. Further, the arrangement of the FIG. 10 electronic musical instrument may be provided with various kinds of network interfaces and modems, whereby data and parameters, such as phoneme data, may be downloaded by way of a network or a telephone line, or synthesized singing sounds may be transferred via the network.

As described above, the singing sound-synthesizing apparatus according to the second embodiment uses a PCM tone generator (waveform-synthesizing process) for generating unvoiced consonants, and therefore it is possible to synthesize and generate high-quality singing sounds.

Further, since data obtained by analyzing PCM waveforms corresponding to phonemes as unvoiced consonants are used as parameters related to the phonemes, it is possible to realize a smooth coarticulation.

Further, since a phoneme data base containing data of phonemes corresponding to respective singers can be provided, it is possible to generate singing sounds of various kinds of singers with ease.

The invention is not limited to the embodiments described above, but it may be implemented in various forms. For instance, although in the above embodiments, song data are stored in the data memory 4, this is not limitative, but they may be supplied from an external device via a MIDI interface.

Further, the method of synthesizing vocal sounds in the first embodiment is not limited to the formant synthesization method, but any other suitable method may be used for synthesizing vocal sounds. Moreover, the CPU itself may be provided with a function of performing the vocal sound-synthesizing process.

What is claimed is:

1. A singing sound-synthesizing apparatus for sequentially synthesizing vocal sounds based on singing data comprising a plurality of sets of sounding data and lyric data, each of said sets corresponding to a note of a song, said sounding data designating at least a pitch of said note and a sounding time period over which said note is sounded, said lyric data being indicative of a lyric formed of at least one phoneme corresponding to said note, the singing sound-synthesizing apparatus comprising:

a designating device that, when said lyric data is indicative of a lyric formed of a plurality of phonemes, designates a predetermined voiced phoneme from said plurality of phonemes of said lyric data; and a sounding control device that carries out sounding control such that sounding of said predetermined voiced phoneme designated by said designating device is started within said sounding time period designated for said plurality of phonemes by a corresponding one of said sounding data and continued until said sounding time period designated for said plurality of phonemes elapses.

2. A singing sound-synthesizing apparatus according to claim 1, wherein said sounding control device causes a phoneme of said plurality of phonemes, which follows said predetermined voiced phoneme designated by said designating device, to be sounded after said sounding time period designated for said plurality of phonemes by said sounding data has elapsed.

3. A singing sound-synthesizing apparatus according to claim 2, wherein said sounding data designates said sounding time period in terms of relative time period which can be varied depending at least on a tempo at which said singing data is sounded.

4. A singing sound-synthesizing apparatus according to claim 3, wherein said lyric data comprises phoneme code data designating each of said plurality of phonemes, and phoneme sounding data designating a phoneme sounding time period corresponding to said each of said plurality of phonemes each in terms of absolute time period.

5. A singing sound-synthesizing apparatus according to claim 1, including a formant-synthesizing tone generator device that synthesizes formants of each of said plurality of phonemes to generate a vocal sound signal, a storage device that stores said singing data, and a phoneme data base that stores phoneme parameter sets for generating said plurality of phonemes and coarticulation parameter sets each for coarticulating a preceding one of said plurality of phonemes and a following one of said plurality of phonemes, and wherein said sounding control device reads said singing data from said storage device, reads ones of said phoneme parameter sets and ones of said coarticulation parameter sets corresponding to the read singing data from said phoneme data base, and supplies a control signal to said formant-synthesizing tone generator device based on said corresponding ones of said phoneme parameter sets and said corresponding ones of said coarticulation parameter sets read from said phoneme data base to cause said formant-synthesizing tone generator device to generate said vocal sound signal.

6. A singing sound-synthesizing method for sequentially synthesizing vocal sounds based on singing data comprising a plurality of sets of sounding data and lyric data, each of said sets corresponding to a note of a song, said sounding data designating at least a pitch of said note and a sounding time period over which said note is sounded, said lyric data being indicative of a lyric formed of at least one phoneme corresponding to said note, the singing sound-synthesizing method comprising the steps of:

designating a predetermined voiced phoneme from said plurality of phonemes of said lyric data, when said lyric data is indicative of a lyric formed of a plurality of phonemes; and carrying out sounding control such that sounding of said predetermined voiced phoneme designated is started within said sounding time period designated for said plurality of phonemes by a corresponding one of said sounding data and continued until said sounding time period designated for said plurality of phonemes elapses.

7. A singing sound-synthesizing method according to claim 6, including the step of causing a phoneme of said plurality of phonemes, which follows said predetermined voiced phoneme designated, to be sounded after said sounding time period designated for said plurality of phonemes by said sounding data has elapsed.

8. A singing sound-synthesizing method according to claim 6, wherein said sounding data designates said sounding time period in terms of relative time period which can be varied depending at least on a tempo at which said singing data is sounded.

9. A singing sound-synthesizing apparatus for reproducing a musical piece including lyrics, comprising:

a formant-synthesizing tone generator device that synthesizes formants of phonemes to generate vocal sounds, said formant-synthesizing tone generator device having a voiced sound tone generator group for generating voiced sounds and an unvoiced sound tone generator group for generating unvoiced sounds;

a PCM tone generator device that generates vocal sounds by pulse code modulation, said PCM tone generator device having a waveform memory storing waveforms of unvoiced consonants;

a storage block that stores singing data corresponding to each lyric of said lyrics of said musical piece;

a phoneme data base that stores phoneme parameter sets for generating said phonemes and coarticulation parameter sets each for coarticulating a preceding one of said phonemes and a following one of said phonemes; and a control device that reads said singing data from said storage block, reads ones of said phoneme parameter sets and ones of said coarticulation parameter sets corresponding to the read singing data from said phoneme data base, and supplies a control signal selectively to at least one of said formant-synthesizing tone generator device and said PCM tone generator device based on said corresponding ones of said phoneme parameter sets and said corresponding ones of said coarticulation parameter sets read from said phoneme data base to cause said at least one of said formant-synthesizing tone generator device and said PCM tone generator device to generate a vocal sound;

wherein said phoneme data base further stores phoneme parameter sets and coarticulation parameter sets obtained by analyzing said waveforms of said unvoiced consonants stored in said waveform memory, said control device causing, when a phoneme designated by any of said corresponding ones of said phoneme parameter sets is one of said unvoiced consonants, both of said PCM tone generator device and said unvoiced sound tone generator group of said formant-synthesizing tone generator device to carry out processing for sounding said one of said unvoiced consonants, and at the same time inhibiting said unvoiced sound tone generator group from outputting results of said processing, thereby effecting smooth coarticulation between said one of said unvoiced consonants and a following voiced sound.

10. A singing sound-synthesizing apparatus according to claim 9, wherein said control device causes said unvoiced sound tone generator group to generate an unvoiced sound which is to be generated simultaneously with a voiced sound.

11. A machine readable storage medium containing instructions for causing said machine to perform a singing sound-synthesizing method of sequentially synthesizing vocal sounds based on singing data comprising a plurality of sets of sounding data and lyric data, each of said sets corresponding to a note of a song, said sounding data designating at least a pitch of said note and a sounding time period over which said note is sounded, said lyric data being indicative of a lyric formed of at least one phoneme corresponding to said note, the singing sound-synthesizing method comprising the steps of:

designating a predetermined voiced phoneme from said plurality of phonemes of said lyric data, when said lyric data is indicative of a lyric formed of a plurality of phonemes; and carrying out sounding control such that sounding of said predetermined voiced phoneme designated is started within said sounding time period designated for said plurality of phonemes by a corresponding one of said sounding data and continued until said sounding time period designated for said plurality of phonemes elapses.

12. A machine readable storage medium containing instructions for causing said machine to perform a singing sound-synthesizing method of sequentially synthesizing vocal sounds based on singing data to thereby reproduce a musical piece including lyrics, the singing sound-synthesizing method comprising the steps of:

reading ones of phoneme parameter sets and ones of coarticulation parameter sets corresponding to said singing data from a phoneme data storing said phoneme parameter sets and said coarticulation parameter sets; and supplying a control signal selectively to at least one of a formant-synthesizing tone generator device that synthesizes formants of phonemes to be sounded to generate vocal sounds, and a PCM tone generator device that generates vocal sounds by pulse code modulation, said PCM tone generator device having a waveform memory storing waveforms of unvoiced consonants, based on said corresponding ones of said phoneme parameter sets and said corresponding ones of said coarticulation parameter sets read from said phoneme data base to cause said at least one of said formant-synthesizing tone generator device and said PCM tone generator device to generate a vocal sound.

13. A singing sound-synthesizing apparatus for reproducing a musical piece including lyrics, comprising:

a formant-synthesizing tone generator device that synthesizes formants of phonemes to generate vocal sounds, said formant-synthesizing tone generator device having a voiced sound tone generator group for generating voiced sounds and an unvoiced sound tone generator group for generating unvoiced sounds;

a PCM tone generator device that generates vocal sounds by pulse code modulation, said PCM tone generator device having a waveform memory storing waveforms of unvoiced consonants;

a storage block that stores singing data corresponding to each lyric of said lyrics of said musical piece;

a phoneme data base that stores phoneme parameter sets for generating said phonemes and coarticulation parameter sets each for coarticulating a preceding one of said phoneme and a following one of said phoneme; and a control device that reads said singing data from said storage block, reads ones of said phoneme parameter sets and ones of said coarticulation parameter sets corresponding to the read singing data from said phoneme data base, and supplies a control signal selectively to at least one of said formant-synthesizing tone generator device and said PCM tone generator device based on said corresponding ones of said phoneme parameter sets and said corresponding ones of said coarticulation parameter sets read from said phoneme data base to cause said at least one of said formant-synthesizing tone generator device and said PCM tone generator device to generate a vocal sound;

wherein said control device causes said unvoiced sound tone generator group to generate an unvoiced sound which is to be generated simultaneously with a voiced sound.

14. A machine readable storage medium containing instructions for causing said machine to perform a singing sound-synthesizing method of sequentially synthesizing vocal sounds based on signing data to thereby reproduce a musical piece including lyrics, the singing sound-synthesizing method comprising the steps of:

reading ones of phoneme parameter sets and ones of coarticulation parameter sets corresponding to said singing data from a phoneme data storing said phoneme parameter sets and said coarticulation parameter sets; and supplying a control signal selectively to at least one of a formant-synthesizing tone generator device that synthesizes formants of phonemes to be sounded to generate vocal sounds, said formant-synthesizing tone generator device having a voiced sound tone generator group for generating voiced sounds and an unvoiced sound tone generator group for generating unvoiced sounds, and a PCM tone generator device that generates vocal sounds by pulse code modulation, said PCM tone generator device having a waveform memory storing waveforms of unvoiced consonants, based on said corresponding ones of said phoneme parameter sets and said corresponding ones of said coarticulation parameter sets read from said phoneme data base to cause said at least one of said formant-synthesizing tone generator device to generate a vocal sound;

wherein said unvoiced sound tone generator group is caused to generate an unvoiced sound which is to be generated simultaneously with a voiced sound.

* * * * *